US007184690B2

(12) United States Patent
Ueno et al.

(10) Patent No.: US 7,184,690 B2
(45) Date of Patent: Feb. 27, 2007

(54) ELECTROPHOTOGRAPHIC PHOTOSENSITIVE DRUM SUPPORTING APPARATUS, PROCESS CARTRIDGE AND ELECTROPHOTOGRAPHIC IMAGE FORMING APPARATUS

(75) Inventors: Takahito Ueno, Shizuoka (JP); Atsushi Numagami, Kanagawa (JP); Isao Koishi, Shizuoka (JP); Akiyoshi Fujita, Shizuoka (JP); Shigeo Miyabe, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 207 days.

(21) Appl. No.: 10/957,835

(22) Filed: Oct. 5, 2004

(65) Prior Publication Data

US 2005/0238387 A1 Oct. 27, 2005

(30) Foreign Application Priority Data

Apr. 26, 2004 (JP) ..... 2004-129672
Sep. 21, 2004 (JP) ..... 2004-273213

(51) Int. Cl.
*G03G 15/00* (2006.01)
*G03G 15/02* (2006.01)

(52) U.S. Cl. ..... 399/117; 399/116; 399/167

(58) Field of Classification Search ..... 399/117, 399/116, 167
See application file for complete search history.

(56) References Cited

U.S. PATENT DOCUMENTS 5,331,373 A 7/1994 Nomura et al. ..... 355/200
5,452,056 A 9/1995 Nomura et al. ..... 355/200
5,463,446 A 10/1995 Watanabe et al. ..... 355/200
5,543,898 A 8/1996 Shishido et al. ..... 355/210
5,585,889 A 12/1996 Shishido et al. ..... 355/200
5,689,774 A 11/1997 Shishido et al. ..... 399/111
5,878,310 A 3/1999 Noda et al. ..... 399/117
5,920,753 A 7/1999 Sasaki et al. ..... 399/111
5,937,239 A 8/1999 Watanabe et al. ..... 399/111

(Continued)

FOREIGN PATENT DOCUMENTS

JP 10-186758 7/1998

*Primary Examiner*—David M. Gray
*Assistant Examiner*—Joseph S. Wong
(74) *Attorney, Agent, or Firm*—Fitzpatrick, Cella, Harper & Scinto

(57) ABSTRACT

An electrophotographic photosensitive drum supporting apparatus for rotatably supporting a photosensitive drum includes a first supporting member having a first hole for supporting one end of the drum, and first and second surfaces on one side and the other side of the first supporting member relative to an imaginary plane passing through the axis of the drum, respectively. The first and second surfaces are inclined with respect to the plane so as to contact with the drum and are provided on the inner surface of the first hole. The apparatus also includes a second supporting member having a second hole for supporting the other end of the drum, and a third and a fourth surfaces on one side and the other side of the second supporting member relative to the plane, respectively. The third and fourth surfaces are inclined with respect to the plane so as to contact with the drum and are provided on the inner surface of the second hole. The apparatus also includes a plurality of process members provided in contact with the drum. The direction of the resultant force of a force acting on the drum by the plurality of process members is a direction in which the drum is urged against the first and second inclined surfaces and against the third and fourth inclined surfaces.

15 Claims, 16 Drawing Sheets

U.S. PATENT DOCUMENTS

| | | | | |
|---|---|---|---|---|
| 5,943,529 | A | 8/1999 | Miyabe et al. | 399/111 |
| 5,946,531 | A | 8/1999 | Miura et al. | 399/111 |
| 5,963,759 | A | 10/1999 | Kojima et al. | 399/111 |
| 5,966,567 | A | 10/1999 | Matsuzaki et al. | 399/111 |
| 5,966,568 | A | 10/1999 | Numagami et al. | 399/111 |
| 6,002,897 | A * | 12/1999 | Kohno et al. | 399/117 |
| 6,006,058 | A | 12/1999 | Watanabe et al. | 399/167 |
| 6,016,413 | A | 1/2000 | Yokoyama et al. | 399/113 |
| 6,029,032 | A | 2/2000 | Watanabe et al. | 399/111 |
| 6,072,968 | A | 6/2000 | Nomura et al. | 399/113 |
| 6,097,909 | A | 8/2000 | Watanabe et al. | 399/111 |
| 6,118,960 | A | 9/2000 | Nakagawa et al. | 399/111 |
| 6,154,623 | A | 11/2000 | Suzuki et al. | 399/111 |
| 6,167,219 | A | 12/2000 | Miyamoto et al. | 399/90 |
| 6,169,866 | B1 | 1/2001 | Watanabe et al. | 399/111 |
| 6,188,857 | B1 * | 2/2001 | Yamanaka et al. | 399/167 |
| 6,246,849 | B1 | 6/2001 | Yokoyama et al. | 399/117 |
| 6,259,873 | B1 * | 7/2001 | Shifley et al. | 399/110 |
| 6,272,299 | B1 | 8/2001 | Numagami et al. | 399/111 |
| 6,282,390 | B1 | 8/2001 | Miyabe et al. | 399/111 |
| 6,289,189 | B1 | 9/2001 | Numagami et al. | 399/111 |
| 6,317,572 | B1 * | 11/2001 | Miyabe et al. | 399/111 |
| 6,330,409 | B1 | 12/2001 | Watanabe et al. | 399/111 |
| 6,336,017 | B1 | 1/2002 | Miyamoto et al. | 399/116 |
| 6,351,620 | B1 | 2/2002 | Miyabe et al. | 399/111 |
| 6,381,429 | B1 * | 4/2002 | Shibata et al. | 399/117 |
| 6,519,431 | B1 | 2/2003 | Toba et al. | 399/111 |
| 6,542,706 | B2 | 4/2003 | Toba et al. | 399/111 |
| 6,549,736 | B2 | 4/2003 | Miyabe et al. | 399/111 |
| 6,577,831 | B1 | 6/2003 | Kojima et al. | 399/111 |
| 6,603,939 | B1 | 8/2003 | Toba et al. | 399/103 |
| 6,608,980 | B2 | 8/2003 | Murayama et al. | 399/111 |
| 6,714,752 | B2 | 3/2004 | Ueno et al. | 399/117 |
| 6,795,666 | B2 | 9/2004 | Miyabe et al. | 399/109 |
| 6,829,455 | B2 | 12/2004 | Yasumoto et al. | 399/167 |
| 2002/0159787 | A1 | 10/2002 | Chadani et al. | 399/109 |
| 2002/0191981 | A1 | 12/2002 | Miyabe et al. | 399/90 |
| 2003/0133723 | A1 | 7/2003 | Fujita et al. | 399/111 |

* cited by examiner

ELECTROPHOTOGRAPHIC PHOTOSENSITIVE DRUM SUPPORTING APPARATUS, PROCESS CARTRIDGE AND ELECTROPHOTOGRAPHIC IMAGE FORMING APPARATUS

BACKGROUND OF THE INVENTION

1. Field of the Invention

The invention relates to an electrophotographic photosensitive drum supporting apparatus for rotatably supporting an electrophotographic photosensitive drum (hereinafter referred to as the "photosensitive drum"), a process cartridge using the electrophotographic photosensitive drum and the supporting apparatus, and an electrophotographic image forming apparatus.

Here, the electrophotographic image forming apparatus is an apparatus for forming an image on a recording medium (e.g., paper or an OHP sheet) by the use of an electrophotographic image forming process. Examples of the electrophotographic image forming apparatus include, for example, an electrophotographic copying machine, an electrophotographic printer (such as a laser beam printer or an LED printer) and a word processor.

Also, the process cartridge refers to at least one of charging means, developing means and cleaning means as process means and a photosensitive drum integrally made into a cartridge which is made detachably mountable on a main body of an electrophotographic image forming apparatus.

2. Description of the Related Art

Heretofore, a process cartridge system has been adopted in the electrophotographic image forming apparatus.

According to this cartridge system, the maintenance of the apparatus can be effected by a user himself without resort to a serviceman. Consequently, operability could be improved. So, this cartridge system is widely used in electrophotographic image forming apparatus.

In recent years, demand for a color electrophotographic image forming apparatus which can effect the forming of a color image has increased.

The color electrophotographic image forming apparatus effects the forming of images of four colors independently of one another. Therefore, the positional deviation of an image-formed point at which an image is formed by each photosensitive drum from a target (ideal) position appears as color misregistration between respective colors in the image.

As a countermeasure for this, there is, for example, a controlling method of measuring the position of the image formed point of each color, and correcting the position. Also, there is a method of disposing a rotary encoder or the like for measuring rotation fluctuation on a drum driving shaft, and controlling a driving motor.

Also, the shape of a bearing for supporting the photosensitive drum is made into a substantially V-shape. There is also conceived a construction for reducing the backlash of the photosensitive drum in the radial direction thereof. In this construction, however, new biasing means is added to the V-shaped portion to bias the photosensitive drum (Japanese Patent Application Laid-Open No. H10-186758 (FIGS. 4 and 5)).

Recently, the downsizing and lower costs of the process cartridge and the electrophotographic image forming apparatus have come to be further demanded. For that purpose, it is necessary to adopt a part construction making the downsizing possible, and decreasing the number of parts. On the other hand, even if the number of parts is decreased, an improvement in the quality of image and the downsizing and lower cost of the apparatus must be produced.

SUMMARY OF THE INVENTION

So, it is an object of the present invention to provide a photosensitive drum supporting apparatus, a process cartridge and an electrophotographic image forming apparatus which have realized an improvement in the rotational accuracy of an electrophotographic photosensitive drum.

It is another object of the present invention to provide a photosensitive drum supporting apparatus, a process cartridge and an electrophotographic image forming apparatus which have realized an improvement in the rotational accuracy of the electrophotographic photosensitive drum to thereby realize an improvement in the quality of image.

It is another object of the present invention to provide a photosensitive drum supporting apparatus, a process cartridge and an electrophotographic image forming apparatus which have realized an improvement in the rotational accuracy of an electrophotographic photosensitive drum without increasing the number of parts.

It is another object of the present invention to provide a photosensitive drum supporting apparatus, a process cartridge and an electrophotographic image forming apparatus which have realized an improvement in the rotational accuracy of an electrophotographic photosensitive drum without making the image forming apparatus bulky.

It is another object of the present invention to provide a photosensitive drum supporting apparatus, a process cartridge and an electrophotographic image forming apparatus which have suppressed an increase in cost and have realized an improvement in the rotational accuracy of an electrophotographic photosensitive drum.

It is another object of the present invention to provide a photosensitive drum supporting apparatus, a process cartridge and an electrophotographic image forming apparatus which, in realizing an improvement in the rotational accuracy of an electrophotographic photosensitive drum, make the direction of the resultant force of a force acting on the electrophotographic photosensitive drum by a plurality of process means into a direction in which the electrophotographic photosensitive drum is urged against a first inclined surface and a second inclined surface and against a third inclined surface and a fourth inclined surface to thereby realize urging the electrophotographic photosensitive drum against each inclined surface.

These and other objects, features and advantages of the present invention will become more apparent upon consideration of the following description of the preferred embodiments of the present invention taken in conjunction with the accompanying drawings.

BRIEF DESCRIPTION OF THE DRAWINGS

FIG. 14A shows the vibration of the drum when supported by the bearing hole shape in the present embodiment. FIG. 14B shows the vibration of the drum when supported by a conventional bearing hole shape (round type).

DESCRIPTION OF THE PREFERRED EMBODIMENTS

A photosensitive drum supporting apparatus according to an embodiment of the present invention, and a process cartridge and an electrophotographic image forming apparatus using the same will hereinafter be described with reference to the drawings. In the present embodiment, a multi-color image forming apparatus for forming a color image with four process cartridges mounted thereon will be shown by way of example.

[General Construction of the Image Forming Apparatus]

Figure 1:
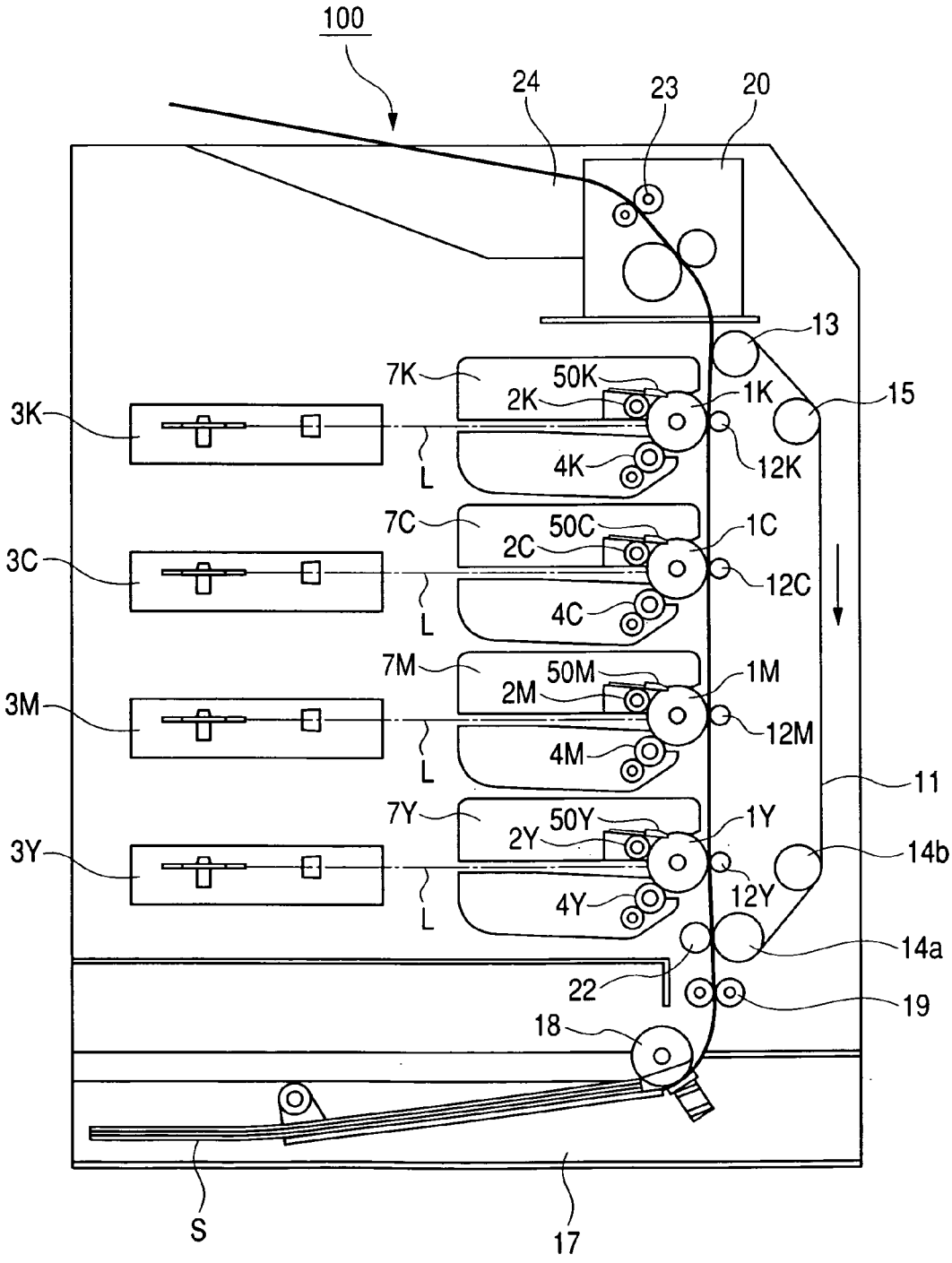
FIG. 1 is cross-sectional view showing an example of a multi-color image forming apparatus.

The general construction of the electrophotographic image forming apparatus will first be described. FIG. 1 is a cross-sectional view of a color laser printer as the electrophotographic image forming apparatus according to the present embodiment.

As shown in FIG. 1, the color laser printer (hereinafter referred to as the printer) 100 according to the present embodiment has four process cartridges (hereinafter referred to as the cartridges) having electrophotographic photosensitive drums (hereinafter referred to as the "photosensitive drums") rotated at a constant speed for respective colors, i.e., yellow (Y), magenta (M), cyan (C) and black (K), and conveying means for conveying a recording medium to the cartridges. Here, the cartridges 7 are detachably mounted on the main body 100A of the printer (a main body of an image forming apparatus).

The cartridges 7 have photosensitive drums 1 (1Y, 1M, 1C, 1K) rotatably driven (in a counterclockwise direction in FIG. 1), charging rollers 2 (2Y, 2M, 2C, 2K) for charging the photosensitive drums 1, developing units 4 (4Y, 4M, 4C, 4K) and cleaner units 50 (50Y, 50M, 50C, 50K).

In case of image forming, exposure conforming to image information is effected from scanner units (3Y, 3M, 3C, 3K) to the photosensitive drums 1 whose surfaces have been uniformly charged by the charging rollers 2. Thereby, electrostatic latent images are formed on the photosensitive drums 1. The electrostatic latent images are developed by developing means in the developing units 4. Here, the scanner units (3Y, 3M, 3C, 3K) are provided in the main body 100A.

As described above, in the image forming portion of the present embodiment, the main members thereof are made into cartridges as the process cartridges 7 (7Y, 7M, 7C, 7K) and are made detachably mountable on the main body 100A of the apparatus.

Also, the conveying means for conveying the recording medium S to the cartridges 7, and thereafter discharging the recording medium S out of the main body 100A of the apparatus has a cassette 17, a feed roller 18, registration rollers 19, an electrostatic transfer belt 11 and a pair of discharge rollers 23. This will hereinafter be described. The recording media S are contained in the cassette 17 disposed in the lower portion of the main body 100A of the apparatus. The feed roller 18 separates and feeds the recording media S one by one from the cassette 17. The registration rollers 19 convey the recording media S to the transfer belt 11 in synchronism with image forming. Thereafter, the transfer belt 11 successively conveys the recording media S to the respective cartridges 7. The transfer belt 11 is passed over supporting rollers 13, 14*a*, 14*b* and 15 and is rotatable, and electrostatically attracts the recording media S and conveys the recording media S to positions opposed to the respective photosensitive drums 1.

Transfer rollers (12Y, 12M, 12C, 12K) (process means) are juxtaposed at positions opposed to the respective photosensitive drums 1 inside the transfer belt 11 so as to contact with the transfer belt 11. By the application of a bias to the transfer rollers, developer images of respective colors formed on the photosensitive drums 1 are successively superimposed and transferred to the recording medium S conveyed by the transfer belt 11. Thereby, a color image is formed on the recording medium S. Here, the transfer rollers are urged against the surfaces of the photosensitive drums by the resilient force of a spring 82 (see FIG. 16). The transfer rollers are driven to rotate by the photosensitive drums 1. The transfer rollers urge the photosensitive drums 1 by the resilient force of the spring 82. That is, the transfer rollers act on the photosensitive drums 1 by the resilient force of the spring 82.

The recording medium S on which the color image has been formed in the aforedescribed manner is conveyed to a fixing portion 20. In the fixing portion, heat and pressure are applied to the recording medium S, and the developer image transferred thereto is fixed on the recording medium S. Thereafter, the recording medium S is discharged to a discharging portion 24 on the upper surface of the apparatus 100 by the pair of discharge rollers 23.

[General Construction of the Process Cartridge]

Figure 2:
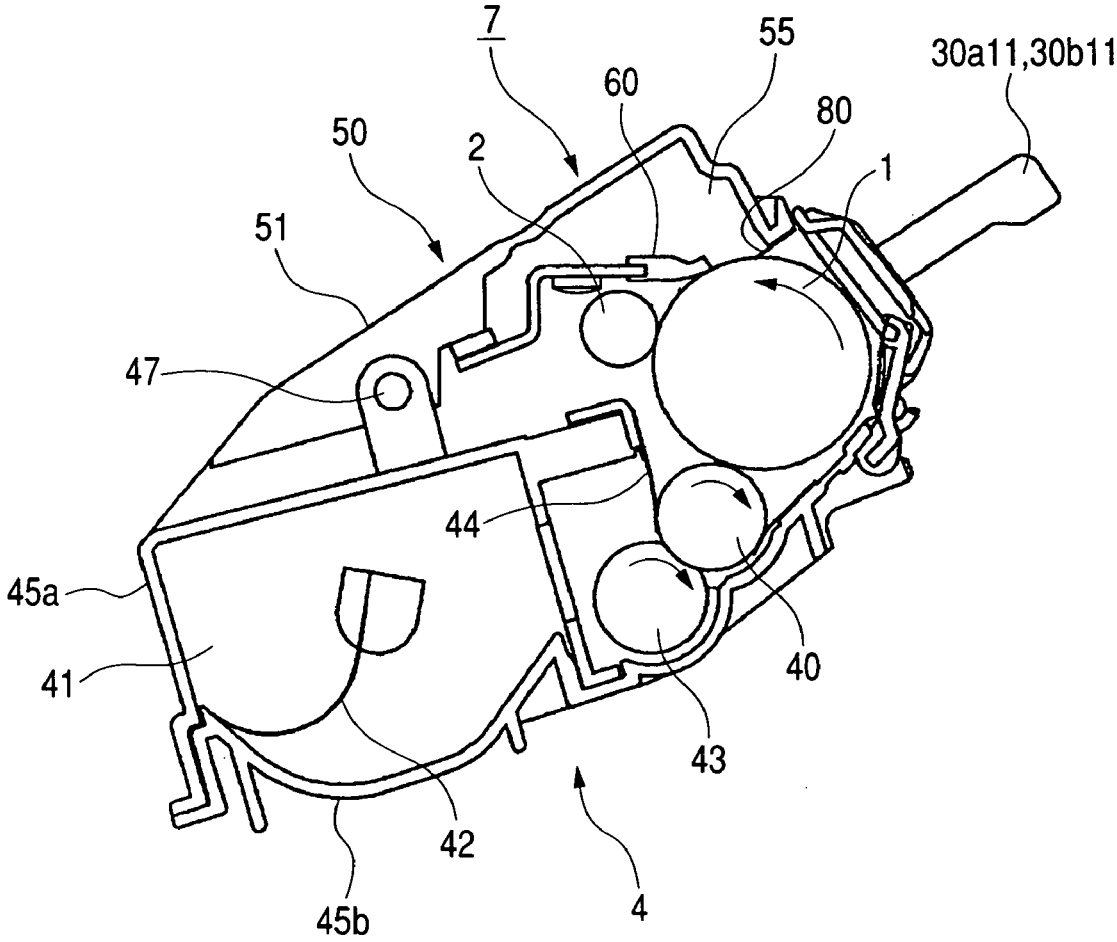
FIG. 2 is a cross-sectional view showing a process cartridge.

Reference is now had to FIG. 2 to describe the general construction of the process cartridges. The cartridges 7 of the present embodiment are the cartridge 7Y containing a yellow developer therein, the cartridge 7M containing a magenta developer therein, the cartridge 7C containing a cyan developer therein, and the cartridge 7K containing a black developer therein. The cartridges 7Y, 7M, 7C and 7K are of the same construction, and charging means, developing means and cleaning means as process means are disposed around the respective photosensitive drums 1.

Each photosensitive drum 1 comprises, for example, an aluminum cylinder 1*a* (see FIG. 7) and a photosensitive layer provided on the outer peripheral surface thereof. The photosensitive drum 1 has its opposite end portions rotatably supported by a photosensitive drum supporting apparatus which will be described later. A driving force is transmitted from a driving motor (not shown) to one end portion of the photosensitive drum 1. Thereby, the photosensitive drum 1 is rotated (in a counterclockwise direction).

Figure 16:
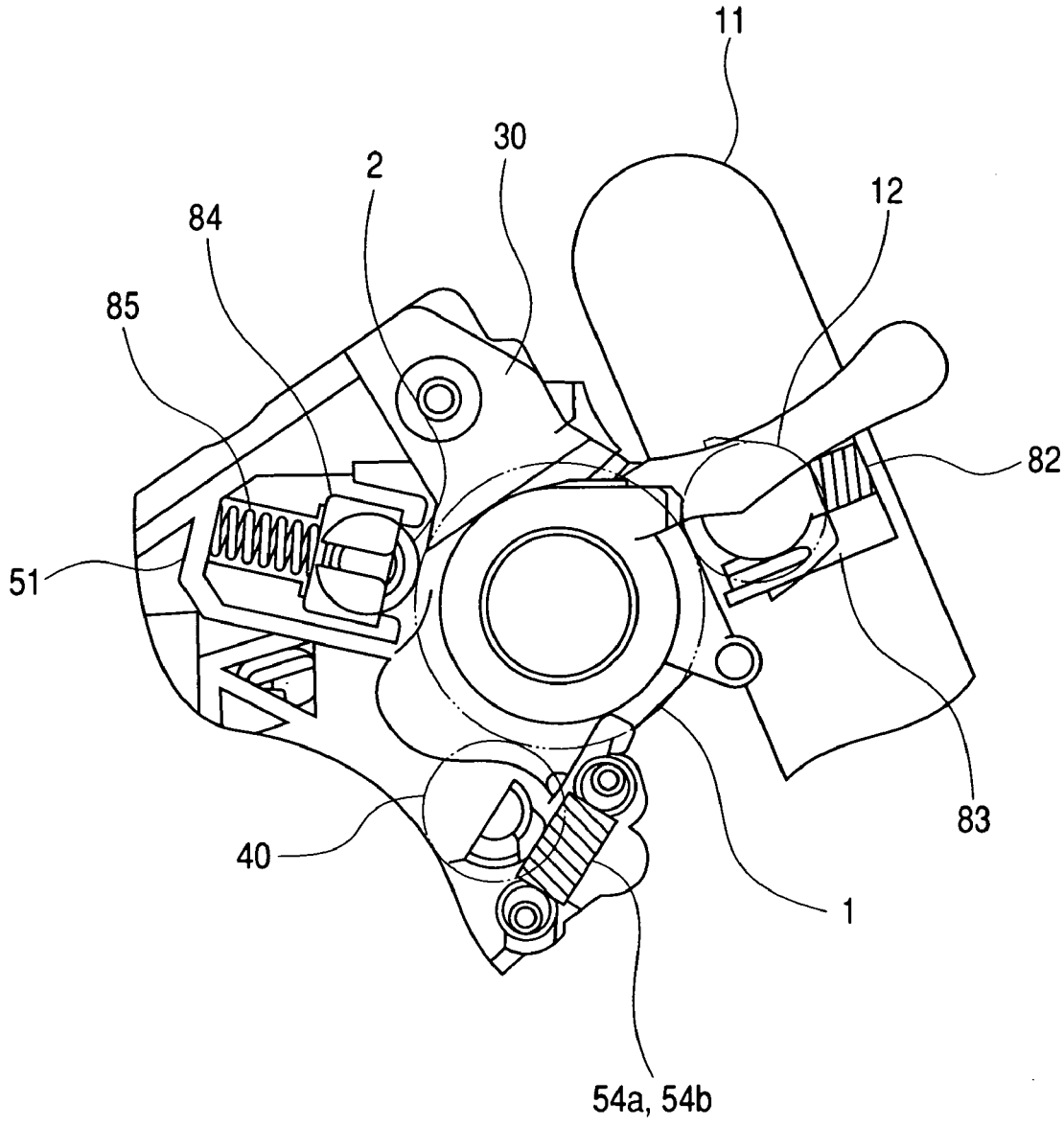
FIG. 16 is a cross-sectional view showing the urging construction of process means urging the photosensitive drum.

A charging roller 2 (process means) as the charging means uniformly charges the surface of the photosensitive drum 1. In the present embodiment, an electrically conductive charging roller 2 formed into a roller shape is biased and brought into contact with the surface of the photosensitive drum 1 by the resilient force of a spring 85 (as shown in FIG. 16). A charging bias voltage is applied to this charging roller 2 to thereby uniformly charge the surface of the photosensitive drum 1. The charging roller 2 is driven to rotate by the photosensitive drum 1. The charging roller 2 urges the photosensitive drum 1 by the resilient force of the spring 85. That is, the charging roller 2 acts on the photosensitive drum 1 by the resilient force of the spring 85.

A developing roller 40 (process means) as the developing means develops an electrostatic latent image formed on the photosensitive drum 1. The developing roller 40 is provided in a developing unit 4. The unit 4 is provided with a developer container (developer containing portion) 41 containing a developer therein, developer feeding means 42 and a developer supplying roller 43. The developer contained in the developer container 41 is fed to the developer supplying roller 43 by the developer feeding means 42. The developer supplying roller 43 is rotated (in a clockwise direction in FIG. 2) and effects the supply of the developer to the developing roller 40 and the development of the latent image, and thereafter effects the scraping-off of the developer from the developing roller 40. The developer supplied to the developing roller 40 is applied to the outer periphery of the developing roller 40 rotated (in the clockwise direction in FIG. 2), by a developing blade 44 brought into pressure contact with the developing roller 40, and has charges applied thereto. A developing bias is then applied to the developing roller 40. Thereby, a developer image is formed on the photosensitive drum 1 in conformity with the latent image.

A cleaning blade 60 (process means) as the cleaning means removes any residual developer on the photosensitive drum 1 after the developer image has been transferred. The blade 60 is formed by an elastic member of elastic rubber or the like. The blade 60 is urged against the surface of the photosensitive drum 1. The blade 60 is flexed and urges the photosensitive drum 1. That is, the blade 60 acts on the photosensitive drum 1 by the elastic force of the blade 60. The elastic blade 60 is provided in a cleaner unit 50. That is, the cleaner unit 50 is provided with the blade 60 and a removed developer containing chamber (removed developer containing portion) 55 for containing therein the developer removed from the surface of the photosensitive drum 1 by the blade 60.

Figure 3:
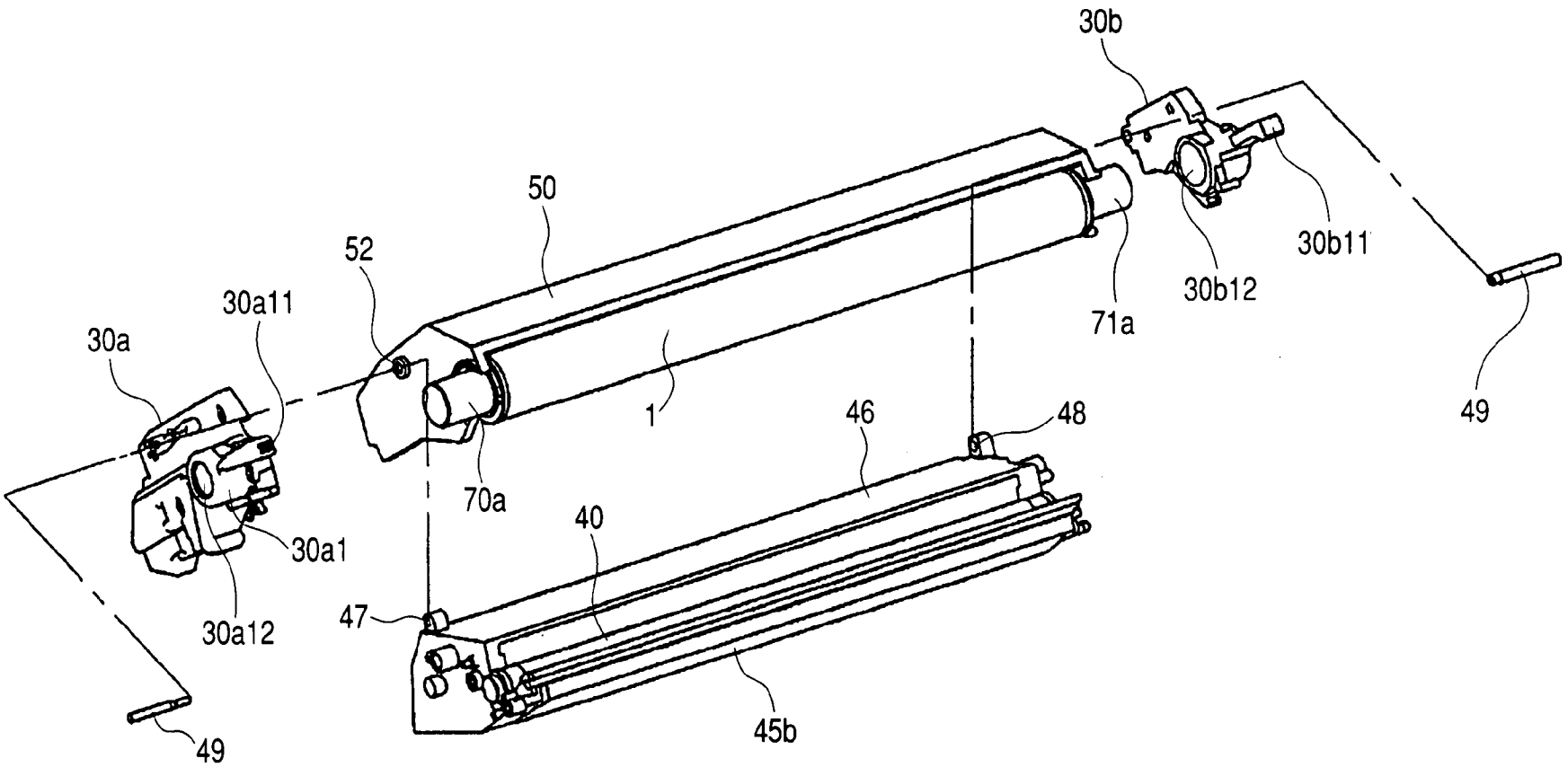
FIG. 3 is a perspective view showing the construction of a process cartridge unit.

The cleaner unit 50 is provided with the photosensitive drum 1 and the charging means besides the cleaning means. As shown in FIGS. 2 and 3, the cleaner unit 50 and the developing unit 4 are pivotally coupled together, whereby the process cartridge 7 is constituted.

In the cleaner unit 50, the photosensitive drum 1 is rotatably mounted on a cleaning frame 51 through bearing members 30 (30*a*, 30*b*) (see FIG. 3). Along the peripheral surface of the photosensitive drum 1, there are disposed the charging roller 2, the cleaning blade 60, a flexible sheet 80 for preventing the developer removed by the blade 60 from leaking from the cleaning frame 51, and the removed developer containing chamber 55. The cleaner unit 50 has the cleaning frame 51. The flexible sheet 80 loosely contacts with the surface of the photosensitive drum 1 so as to permit the developer adhering to the surface of the photosensitive drum 1 to pass (so as not to scrape off such developer).

The developing unit 4 has a developer container frame 46 constituted by developing frames 45*a* and 45*b* being ultrasonically welded together. In the frame 46, there are disposed the developing roller 40, the developer container 41, the developer supplying roller 43 and the developing blade 44.

Connecting hole portions 47 and 48 provided in the opposite ends of the frame 46 and supporting hole portions 52 and 53 (see FIGS. 4A and 4B) provided in the opposite ends of the cleaning frame 51 are put together. Pins 49 are inserted from the opposite ends of the unit 50. Thereby, the whole of the developing unit 4 is supported for pivotal movement relative to the cleaner unit 50.

Figure 4A:
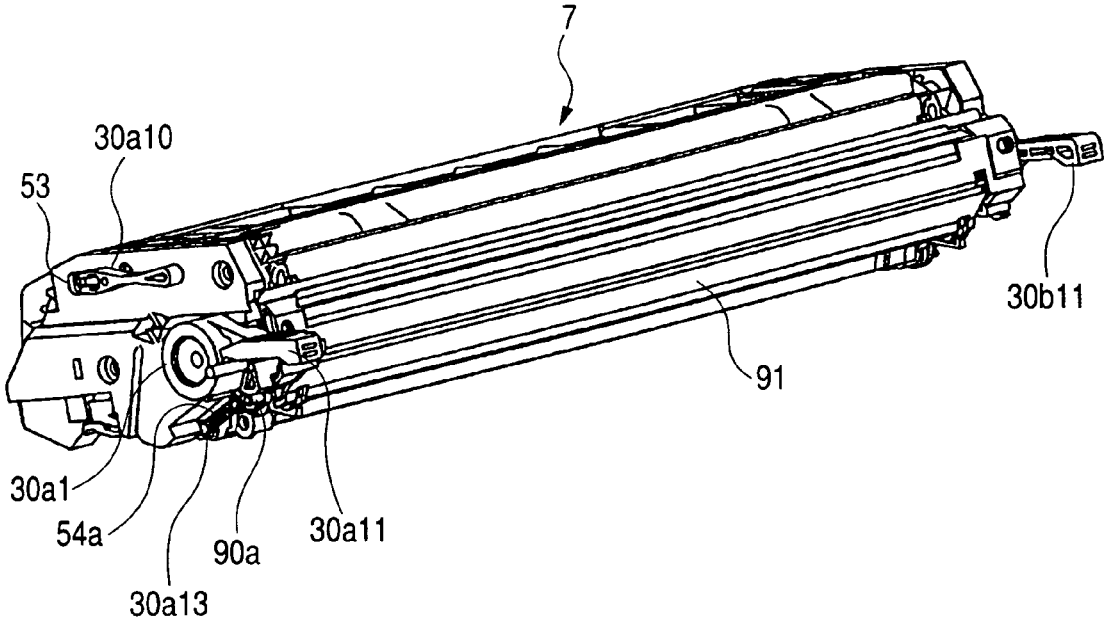
FIGS. 4A and 4B are perspective views showing the process cartridge unit.
Figure 4B:
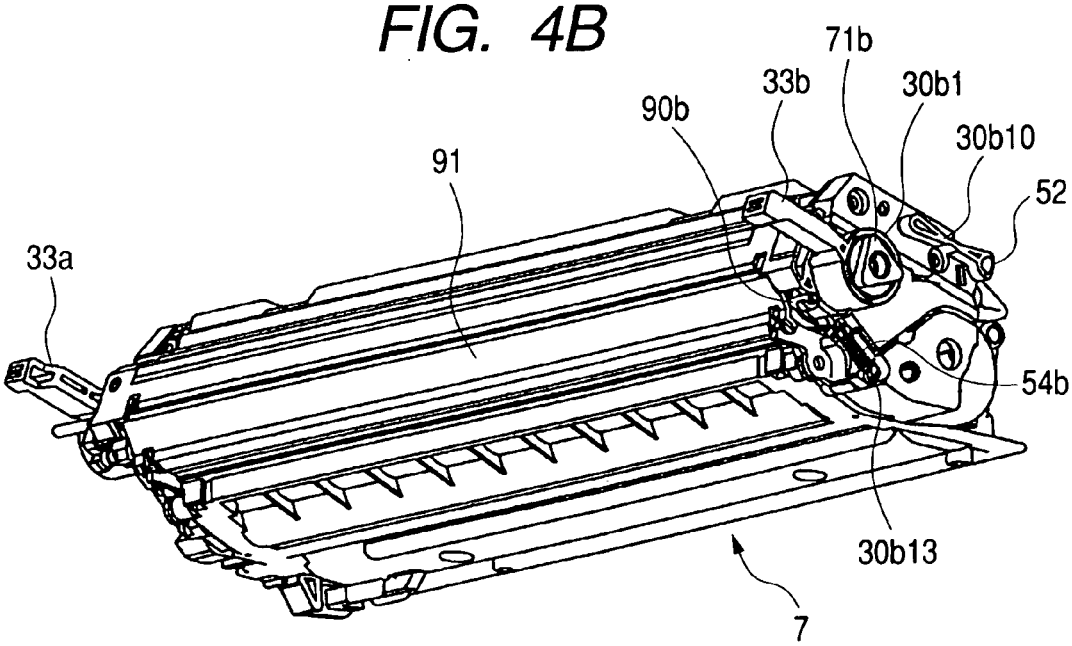

Also, as shown in FIGS. 4A and 4B, by the resilient forces of developing pressure springs 54*a* and 54*b*, which are resilient members mounted on the lengthwise opposite sides of the developing roller 40 about hole portions for the pins 49, the developing unit 4 is always biased against the cleaner unit 50. Thereby, the developing roller 40 urges the photosensitive drum 1 by the resilient forces of the springs 54*a* and 54*b*. That is, the developing roller 40 acts on the photosensitive drum 1 by the resilient forces of the springs 54*a* and 54*b*. At this time, the developing roller 40 maintains a minute interval (about hundreds of μm) between it and the photosensitive drum 1 by spacer runners (not shown) mounted on the opposite ends thereof. That is, the developing roller 40 urges the photosensitive drum 1 through the spacer runners.

A rotatable driving force is transmitted from the main body 100A to the developing roller 40 by driving force transmitting means (not shown).

[Construction for Mounting and Dismounting the Process Cartridge with Respect to the Image Forming Main Body of the Apparatus]

Figure 5:
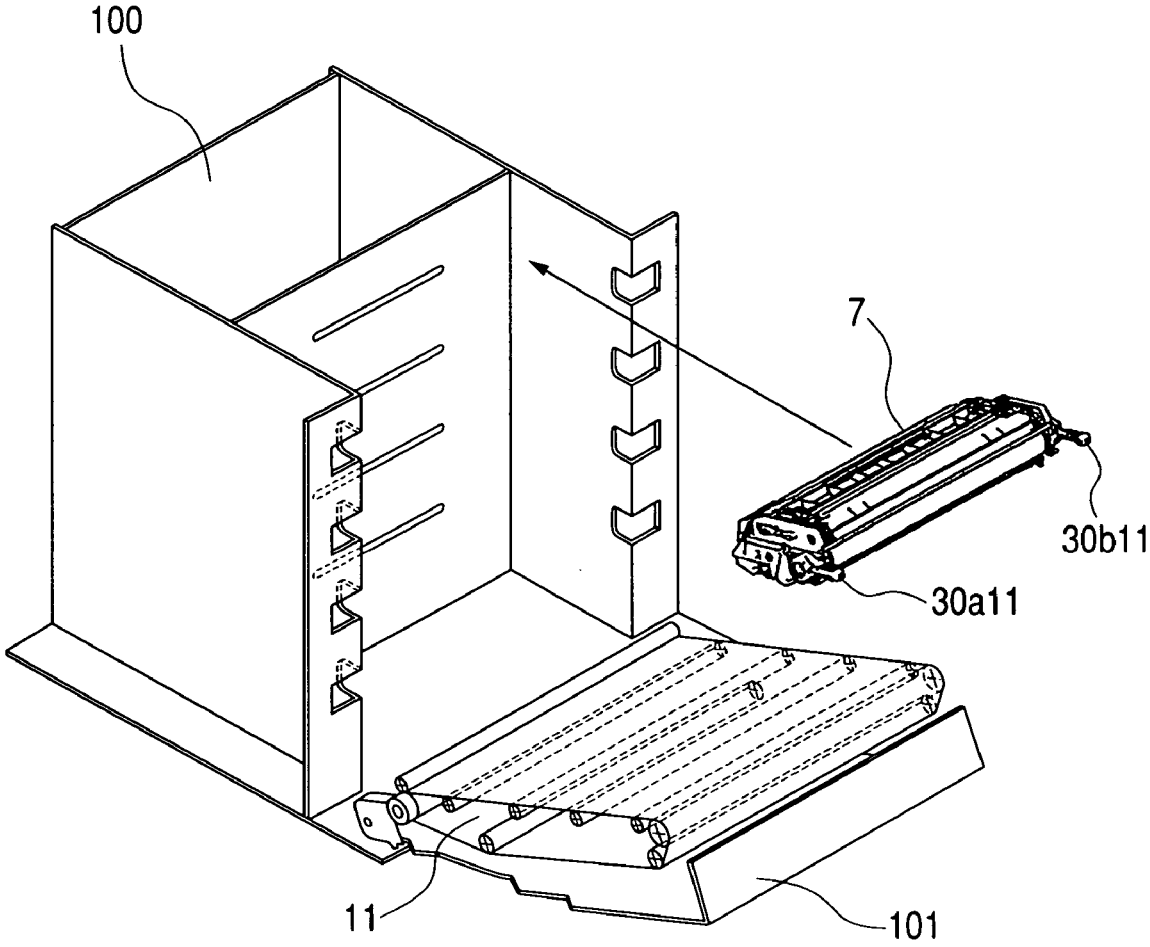
FIG. 5 is a perspective view of mounting means for mounting the process cartridge on a main body of an apparatus.
Figure 6:
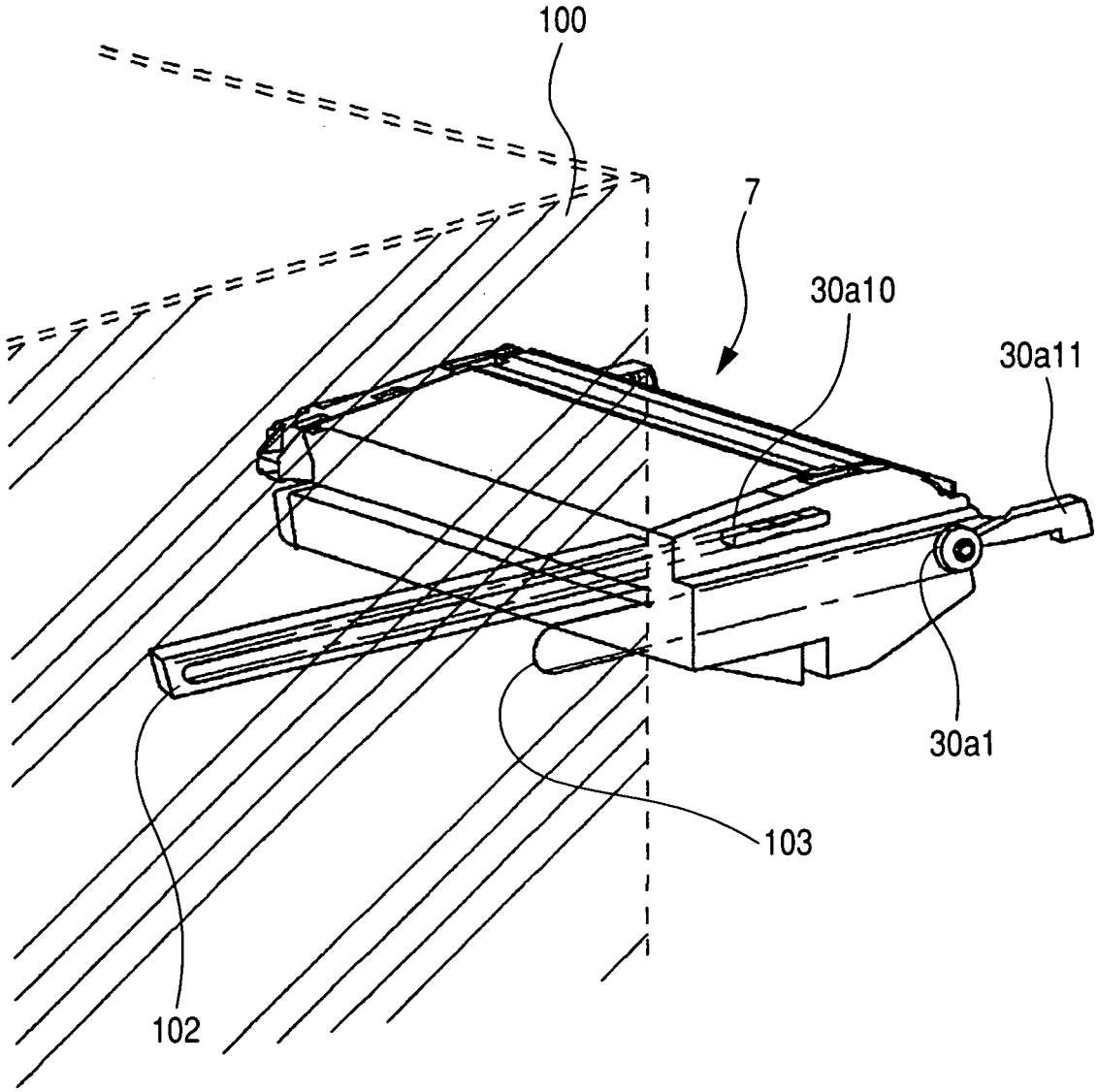
FIG. 6 is as perspective view of the mounting means for mounting the process cartridge on the main body of the apparatus.

Reference is now had to FIGS. 5 and 6 to describe the construction of mounting means for mounting and dismounting the cartridge 7 with respect to the main body 100A of the apparatus.

As shown in FIG. 5, a front door 101 is pivotably provided on the main body 100A of the apparatus. Also, the transfer belt 11 is mounted on the inside of the front door 101. Thereby, the transfer belt 11 is also provided for pivotal movement relative to the main body 100A of the apparatus. With the front door 101 and the transfer belt 11 opened, the cartridge 7 becomes detachably mountable with respect to the main body 100A of the apparatus.

As shown in FIG. 3 and FIGS. 4A and 4B, on the lengthwise opposite ends of the cartridge 7, there are provided positioned portions 30*a*1 and 30*b*1 for positioning the cartridge 7 in the main body 100A of the apparatus, and guide portions 30*a*10 and 30*b*10 providing guides when the cartridge 7 is mounted and dismounted with respect to the main body 100A of the apparatus.

Also, grip portions 30*a*11 and 30*b*11 are provided on the lengthwise opposite ends of the cartridge 7 (FIGS. 2, 4A, 4B, 5, etc.). An operator, when he mounts or dismounts the cartridge 7 with respect to the main body 100A, grips these grip portions 30*a*11 and 30*b*11.

On the other hand, as shown in FIG. 6, the main body 100A of the apparatus is provided with groove-shaped main body positioning portions 103 in which positioned portions 30*a*1 and 30*b*1 are inserted, and guide rails 102 for guiding guide portions 30*a*10 and 30*b*10 (only one side of the guide rails 102 and the main body positioning portions 103 is shown).

Thereby, with the guide portions 30*a*10 and 30*b*10 along the guide rails 102, the cartridge 7 is inserted into the main body 100A. Then, the positioned portions 30*a*1 and 30*b*1 are rammed against the main body positioning portion 103. Thereby, the positioning of the cartridge 7 with respect to the main body 100A of the apparatus can be effected. At this, the operator holds the grip portions 30*a*11 and 30*b*11, whereby the mounting or dismounting of the cartridge 7 can be effected easily.

[Construction for Supporting and Positioning the Photosensitive Drum]

A description will now be provided of a construction for positioning and supporting the photosensitive drum 1 (the construction of a drum supporting apparatus) in the present embodiment.

Figure 7:
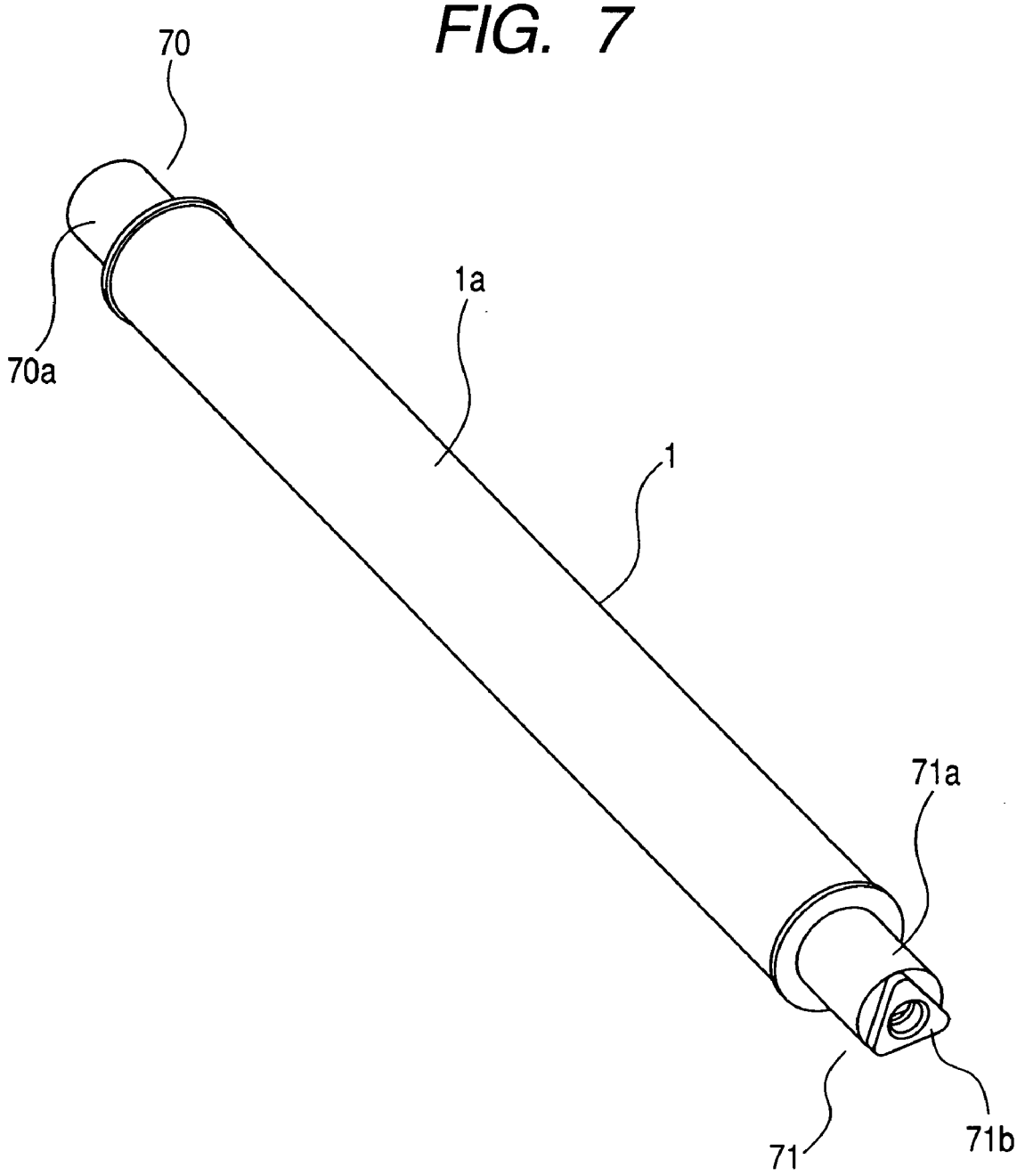
FIG. 7 is a perspective illustration of a photosensitive drum.

As shown in FIG. 7, the photosensitive drum 1 has a cylinder 1*a* having a photosensitive layer applied thereto, and shaft portions 70*a* and 71*a* provided on one lengthwise end and the other lengthwise end of the cylinder 1*a* for supporting the cylinder 1*a*. That is, there are provided the shaft portions 70*a* and 71*a* for supporting the photosensitive drum 1 on the cleaning frame (cartridge frame) 51. More particularly, flanges 70 and 71 are fixed to the opposite ends of the cylinder 1*a*. The shaft portions 70*a* and 71*a* having a column shape having a diameter smaller than the outer diameter of the cylinder protruding from the flange 70 on one end side (non-driving side) and the flange 71 on the other end side (driving side), respectively. The photosensitive drum 1 is such that the entire axial areas of the shaft portions 70*a* and 71*a* thereof are supported for sliding movement relative to the inner surfaces of hold portions 30*a*12 and 30*b*12 (a first hole portion and a second hole portion) provided in a bearing member 30 as a supporting member. The bearing member 30 is mounted on the frame 51. Thereby, the shaft portions 70*a* and 71*a* rotatably support the photosensitive drum 1 on the frame (cartridge frame) 51. Also, on the tip end portion of the shaft portion 71*a*, there is provided a twisted triangular prism-shaped projection 71*b* (cartridge coupling) which is a driving force transmitted portion. This projection 71*b* fits to a driving force coupling (not shown) provided in the main body 100A of the apparatus, whereby a driving force is transmitted from the main body 100A of the apparatus to the photosensitive drum 1 (cartridge 7).

Figure 8:
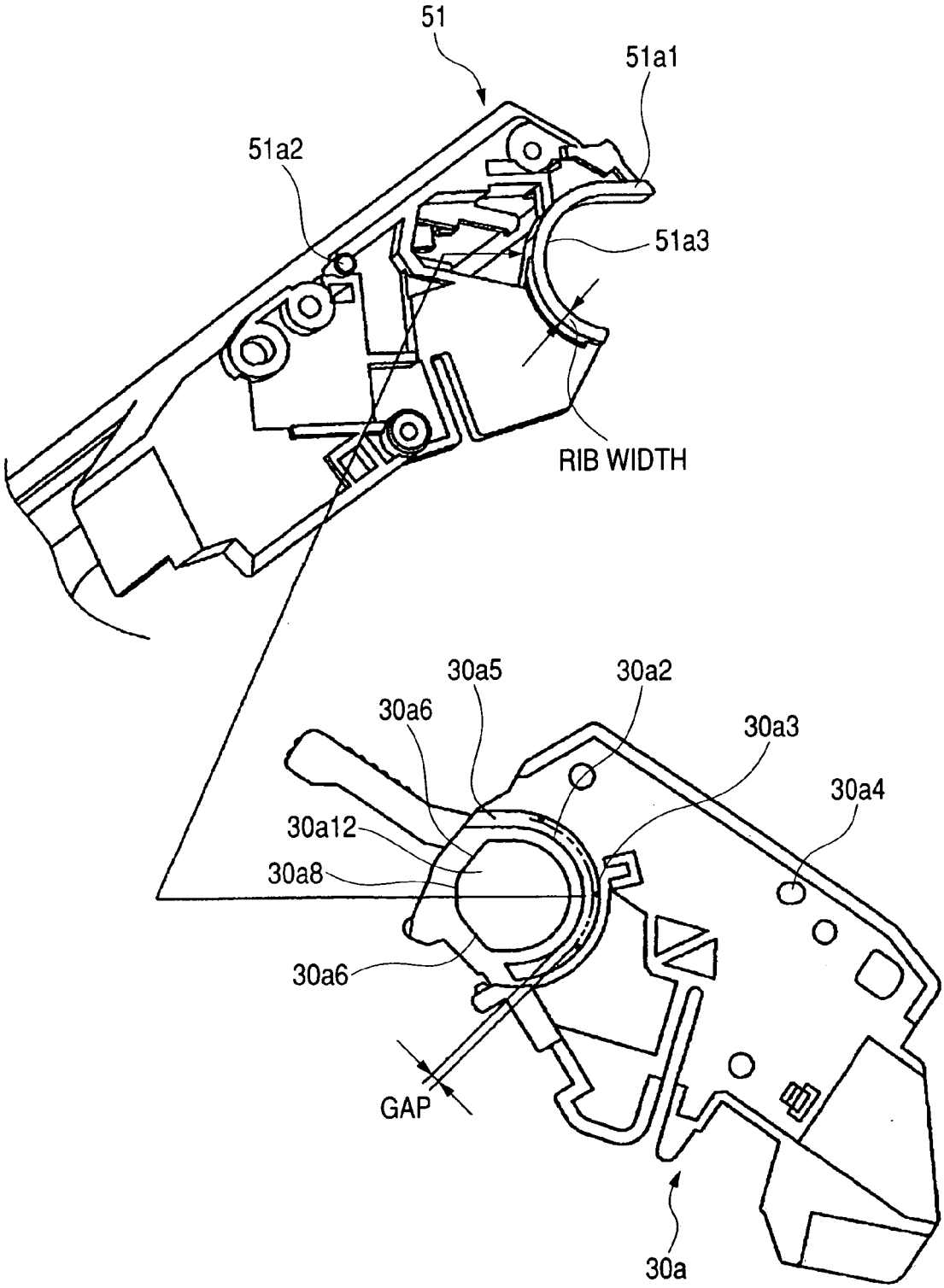
FIG. 8 is a schematic view (non-driving side) showing the coupling of a bearing member and a cleaning frame.
Figure 9:
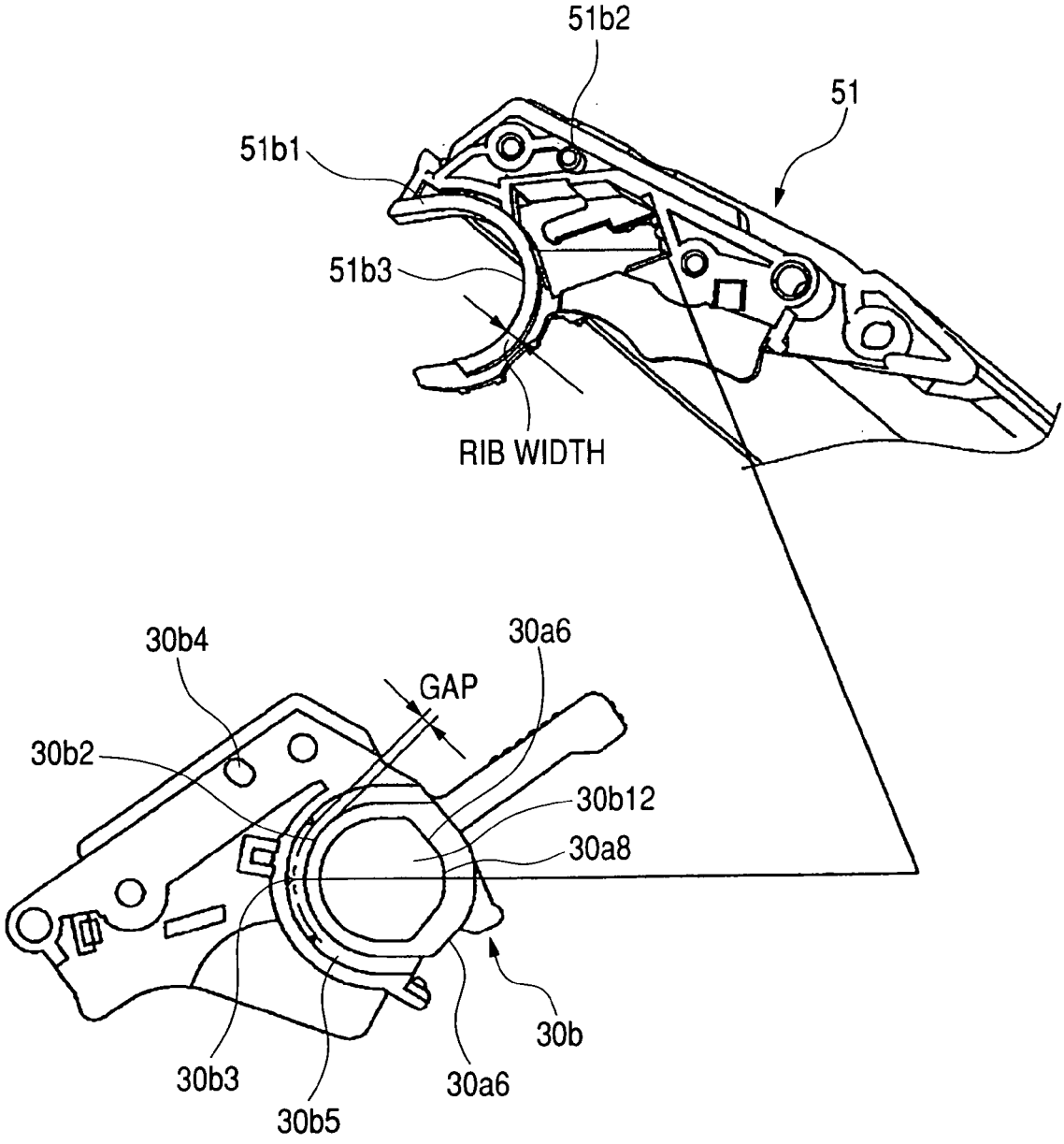
FIG. 9 is a schematic view (driving side) showing the coupling of the bearing member and the cleaning frame.

A description will now be provided of the bearing members 30 as supporting members for rotatably supporting the photosensitive drum 1. These bearing members 30, as previously described, are fixed to the frame 51. That is, as shown in FIGS. 8 and 9, groove portions 30*a*5 and 30*b*5 provided in the bearing members 30 fit to ribs 51*a*1 and 51*b*1, respectively, provided on the frame 51. Also, the groove portions 30*a*5 and 30*b*5 are provided with a plurality of triangular ribs 30*a*3 and 30*b*3, respectively, in the circumferential direction thereof. By a resilient force produced by the ribs 30*a*3 and 30*b*3 being resiliently deformed, arcuate (C-shaped) rib surfaces 30*a*2 and 30*b*2, which are the outer diameter portions of the hole portions 30*a*12 and 30*b*12, respectively, provided in the bearing members 30 are forcibly pushed against arcuate (C-shaped) opening surfaces 51*a*3 and 51*b*3, respectively, provided in the frame 51. Accordingly, the bearing members 30 and the frame 51 are fitted to each other without any gap therebetween. Thereby, the centers of the bearing members 30 are accurately positioned relative to the center of the photosensitive drum in the frame 51.

Further, bosses 51*a*2 and 51*b*2 provided on the frame 51 fit in oval holes 30*a*4 and 30*b*4, respectively, formed in the bearing members 30, whereby the posture of the bearing members 30 is accurately determined. The fixing method for the frame 51 and the bearing members 30 may be carried out by other means such as screw coupling, resin coupling or limonene coupling.

Figure 10A:
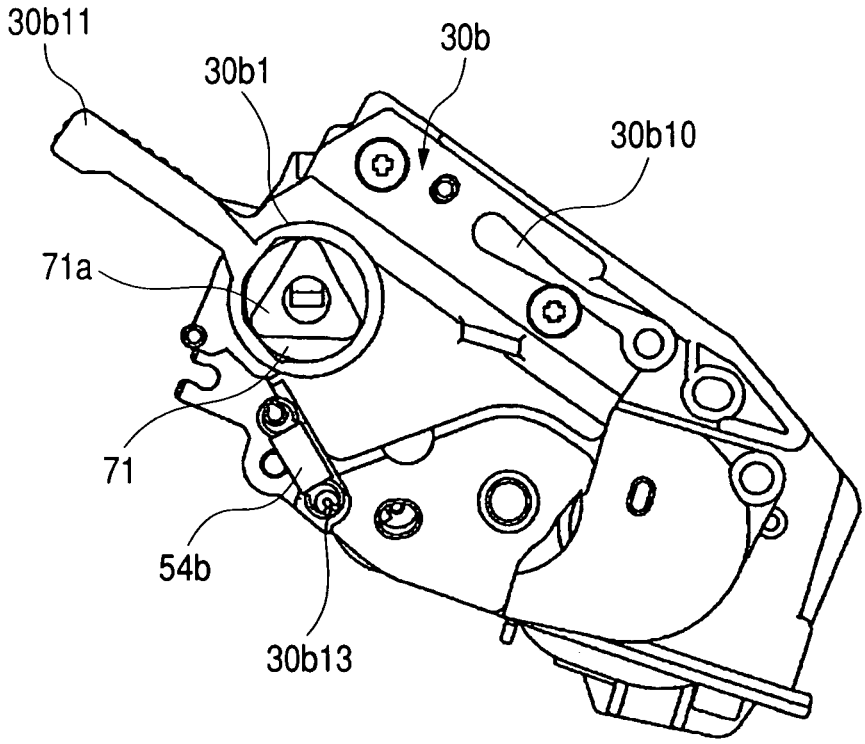
FIG. 10A is a side view showing the driving side of the process cartridge.
Figure 10B:
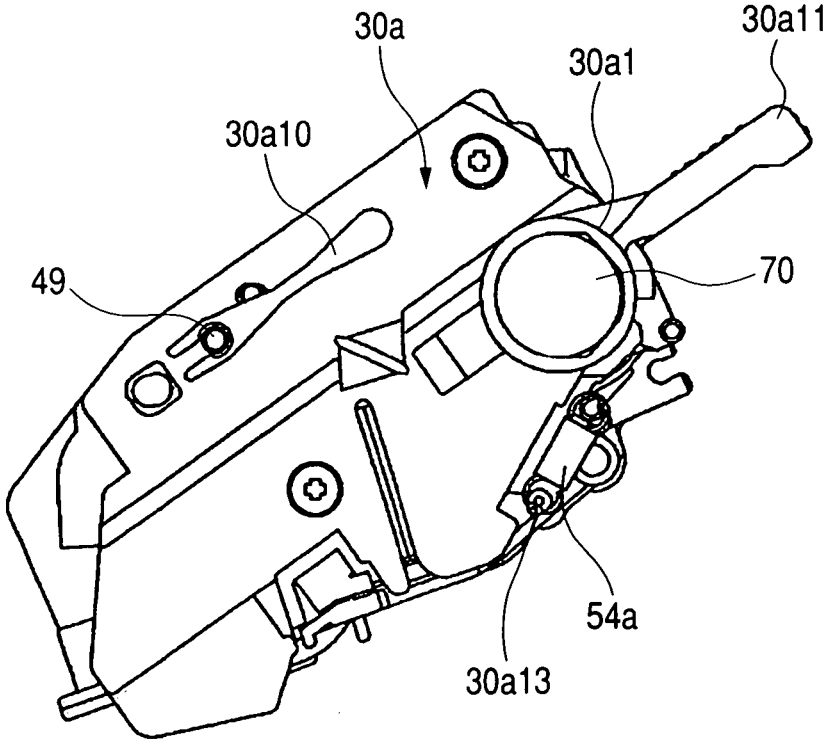
FIG. 10B is a side view showing the non-driving side of the process cartridge.

Also, as shown in FIGS. 3, 10A and 10B, a bearing member 30*a* as a first supporting member supports one lengthwise end of the photosensitive drum 1. This bearing member 30*a* has a hole portion 30*a*12 as a first hole portion for rotatably supporting the shaft portion 70*a*. Also, a bearing member 30*b* as a second supporting member supports the other lengthwise end of the photosensitive drum 1. This bearing member 30*b* has a hole portion 30*b*12 as a second hole portion for rotatably supporting the shaft portion 71*a*. Also, as shown in FIGS. 3, 10A and 10B, the bearing members 30 are such that the portions thereof supporting the shaft portions 70*a* and 71*a* protrude outwardly from the sides of the bearing members 30. These portions are the aforedescribed positioned portions 30*a*1 and 30*b*1. That is, the hole portions 30*a*12 and 30*b*12 are provided in the positioned portions 30*a*1 and 30*b*1, respectively.

In the present embodiment, the shaft portions 70, 71 and the bearing members 30 are formed of resin. Also, a lubricant is applied to sliding portions. However, in a case where the mutual shaving, biting or the like of parts which are in sliding relationship is not feared, the shaft portions 70, 71 and the bearing member 30 may be formed of a metal.

As previously described, the photosensitive drum 1 is rotatably supported by the hole portions 30*a*12 and 30*b*12. At this time, an urging force by the charging roller 2 or the like as the process means acts on the photosensitive drum 1. Thereby, the photosensitive drum 1 (shaft portions 70, 71) is urged against one side of the inner surfaces of the hole portions 30*a*12 and 30*b*12. Thereby, the positioning of the photosensitive drum 1 relative to the frame 51 is done. The positioning construction will now be described in detail.

Figure 11:
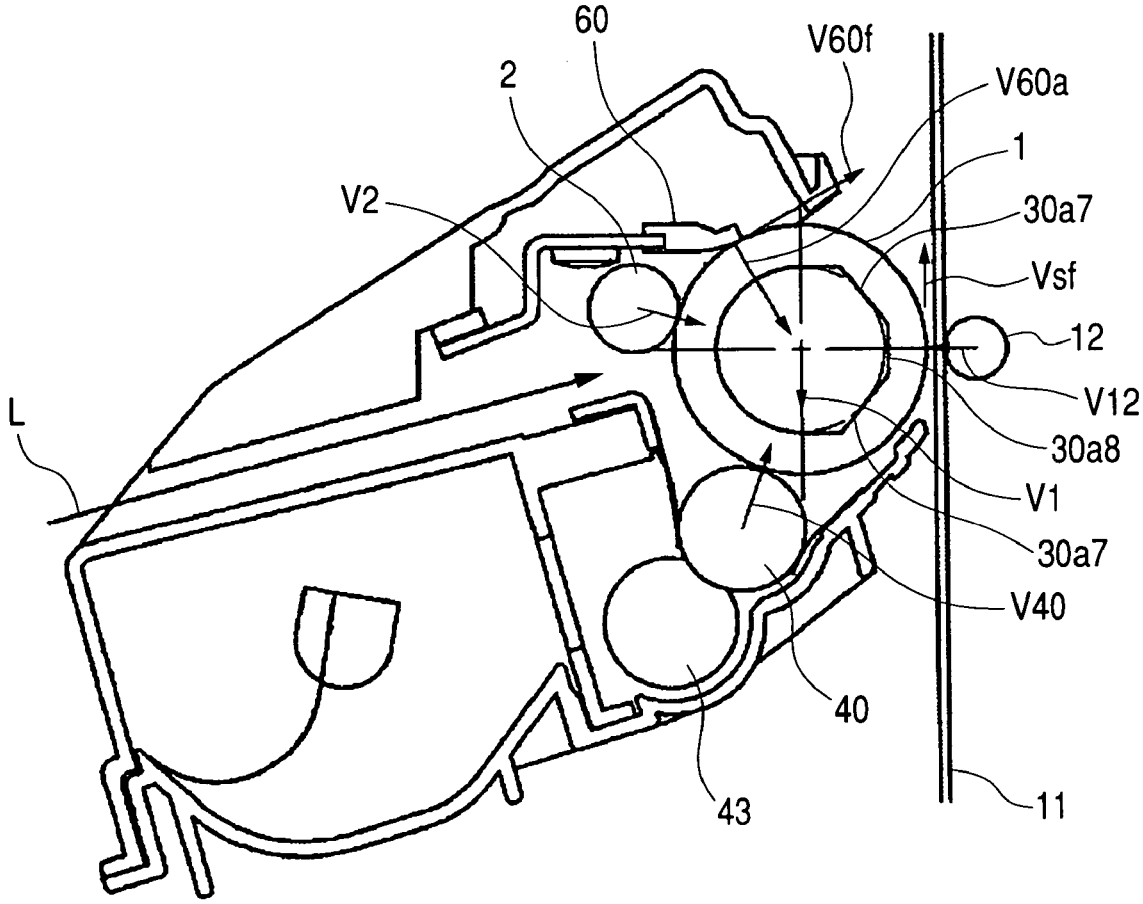
FIG. 11 is a schematic view showing the vector of a force applied to the photosensitive drum.

As previously described, the charging roller 2, etc. as the process means are in contact with the photosensitive drum 1 by a predetermined resilient urging force (resilient biasing force). The urging force acting on the photosensitive drum 1 includes, as indicated by arrows, for example, in FIG. 11, an urging force V2 by the contact of the charging roller 2, an urging force V40 by the contact of the developing roller 40, the frictional force of the developing roller 40 with the rotated photosensitive drum 1, a pressure contact force V60*a* by the blade 60, the frictional force V60*f* of the cleaning blade 60 with the rotated photosensitive drum 1, the meshing force of a main body gear (not shown) provided in the main body 100A for transmitting a rotational force to a main body coupling (not shown) for transmitting a rotational force to the photosensitive drum 1 and a main body driving gear (not shown) meshing with the main body gear to transmit a rotational force to the main body gear (hereinafter referred to as the "drum driving gear meshing force"), an urging force V12 by the transfer roller, gravity V1 acting on the photosensitive drum 1, and a frictional force Vsf by the conveyed recording medium S.

As the process means provided in contact with the photosensitive drum 1, there is the charging roller 2 in the present embodiment. The force acting on the photosensitive drum 1 is a force which resiliently biases the charging roller 2 against the photosensitive drum 1 by the resilient forces of springs 85 as resilient members. The springs 85 are disposed on one end side and the other end side of the charging roller 2.

Also, in the present embodiment, as the process means, there is the developing roller 40 for developing an electrostatic latent image formed on the photosensitive drum 1. The force acting on the photosensitive drum 1 is a force which resiliently urges (biases) the developing roller 40 against the photosensitive drum 1 by the resilient forces of springs 54*a* and 54*b* as resilient members. The springs 54*a* and 54*b* are disposed on one end side and the other end side of the developing roller 40.

Also, in the present embodiment, as the process means, there is the elastic cleaning blade 60 for removing any residual developer on the photosensitive drum 1 from the photosensitive drum 1. The force acting on the photosensitive drum 1 is a force with which the elastic cleaning blade 60 elastically urges (biases) the photosensitive drum 1.

Also, in the present embodiment, as the process means, there is the transfer roller for transferring a developer image formed on the photosensitive drum 1 to the recording medium S. The force acting on the photosensitive drum 1 is a force with which the transfer roller is resiliently urged (biased) against the photosensitive drum 1 by the resilient forces of springs 82 (FIG. 16) as resilient members. The springs 82 are disposed on one end side and the other end side of the transfer roller.

Also, the resilient forces of the developing pressure springs 54*a* and 54*b* (FIGS. 4A, 4B and 16), the meshing force of a cartridge gear (not shown) provided in the cartridge which meshes with the main body driving gear (not shown) provided in the main body 100A of the apparatus to transmit a rotatable driving force to the developing roller 40 (hereinafter referred to as the "developing driving gear meshing force"), and an urging force by the supplying roller 43 are related to the urging force V40 by the contact of the developing roller 40. Regarding the aforedescribed "photosensitive drum driving gear meshing force", in the present embodiment, there is one driving motor provided in the main body 100A, and a gear train branches off from there. Therefore, depending on the position of each mounting portion for mounting the cartridge 7, the vector of a force produced by the "drum driving gear meshing force" differs. In the present embodiment, the resultant force by each force is set to the order of 1000–5000 gf, and the force received by each of the bearing members 30*a* and 30*b* is set to the order of 500–2500 gf.

Figure 12A:
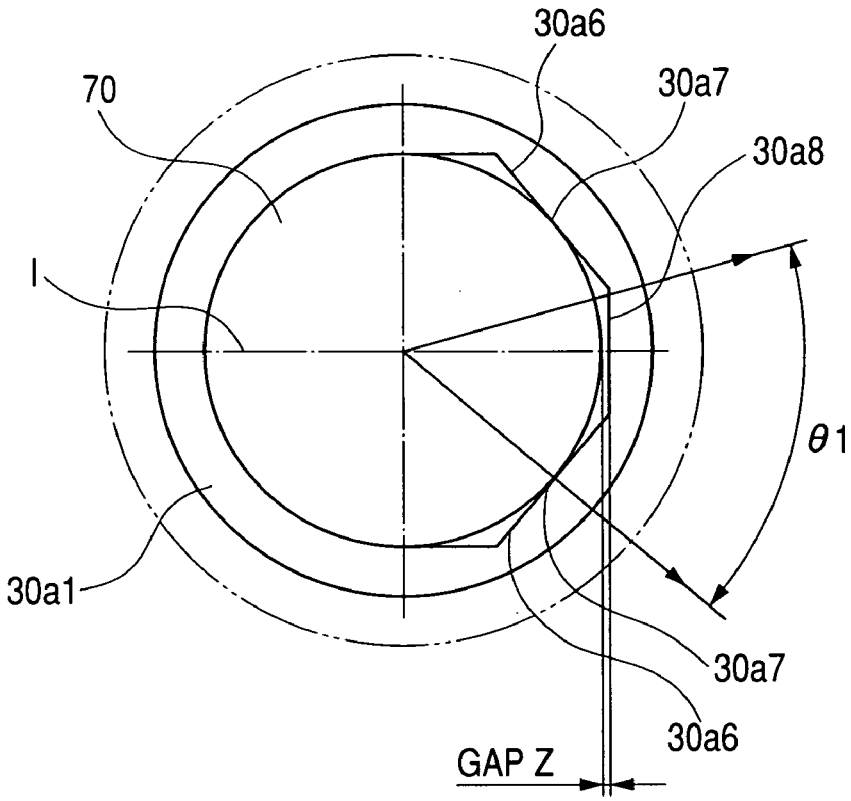
FIG. 12A is a schematic cross-sectional view of the shape of the bearing hole portion of the photosensitive drum.
Figure 12B:
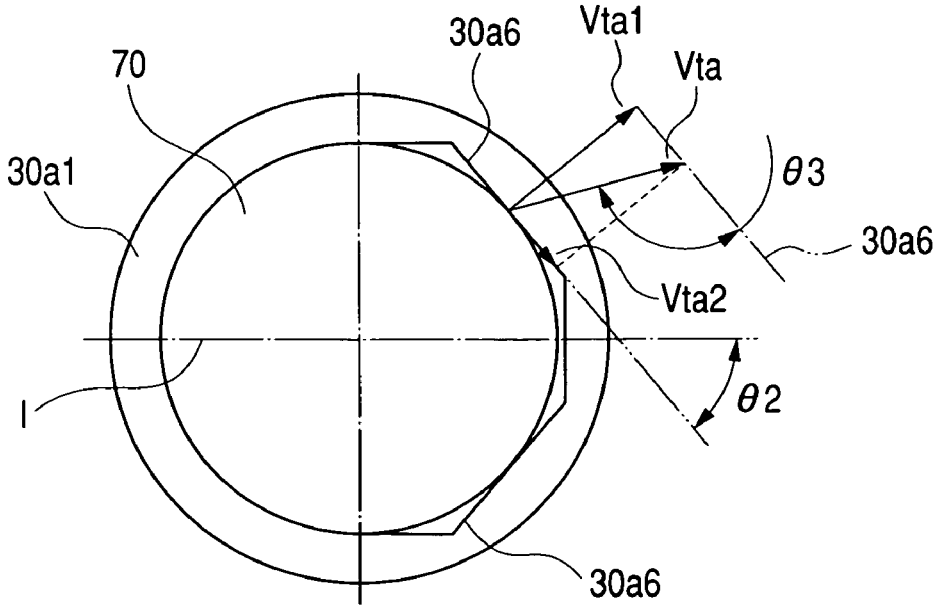
FIG. 12B is a schematic view showing the vector component of a force applied to the bearing hole portion of the photosensitive drum.

Reference is now had to FIGS. 12A and 12B to describe the hole portions of the bearing member 30 for supporting the shaft portions 70 and 71. While in FIGS. 12A and 12B, only one shaft portion 70 side will be described, the other shaft portion 71 side is likewise constructed.

As shown in FIG. 12A, the shape of the hole portion 30*a*12 (which is identified in FIG. 8) for supporting the shaft portion 70 has, relative to the inner diameter (circular shape) substantially of the same size as the outer diameter (of which the axial cross section is of a circular shape) of the shaft portion 70*a*, two contact surfaces 30*a*6 (hereinafter referred to as the tangents when described in a cross section) contacting with the outer periphery of the shaft portion 70, and a surface 30*a*8 on the point of intersection side at which the tangents 30*a*6 are extended and intersect with each other and perpendicular to the horizontal plane of the main body 100A of the apparatus. As previously described, the outer diameter of the shaft portion 70*a* and the inner diameter of the hole portion 30*a*12 are substantially of the same size. However, with a tolerance taken into account, the inner diameter of the hole portion 30*a*12 is designed to be larger than the outer diameter of the shaft portion 70*a* so that the shaft portion 70*a* may fit in the hole portion 30*a*12 without fail. In the image forming apparatus, the surface 30*a*8 is disposed on a side which is an opposed portion opposed to the laser beam L (scanner unit 3) (FIG. 1) and on which the transfer roller is disposed relative to the photosensitive drum 1 (see FIG. 11). The contact surfaces 30*a*6 are disposed on one end side and the other end side of the surface 30*a*8. This surface 30*a*8 has a gap Z with respect to the outer surface of the supported shaft portion 70 (see FIG. 12A). The distance of the gap Z is such a distance that each tangent 30*a*6 will not strike against the bearing member 30 even if in the contact portion 30*a*7, each tangent 30*a*6 contacts with the shaft portion 70 to thereby deform the bearing member 30.

The shaft portion 70 is supported at two points (contact portions 30*a*7) by the contact thereof with the respective tangents 30*a*6. Thereby, the position of the photosensitive drum 1 relative to the bearing portions 30 (frame 51) is accurately determined. Although in FIG. 12A, the other circumferential portion also looks like it contacts the shaft portion 70, actually a gap is formed by an amount corresponding to a fit backlash.

That is, in the present embodiment, the bearing portion 30*a* as a first supporting member has the hole portion 30*a*12 as a first hole portion for supporting one lengthwise end of the photosensitive drum 1, the contact surface 30*a*6 as a first inclined surface (ramming surface) on one side relative to an imaginary plane 1 passing through the axis of the photosensitive drum 1 located in the interior of the hole portion 30*a*12 and inclined with respect to the imaginary plane 1 so as to contact with the outer peripheral surface of the photosensitive drum 1 and provided on the inner surface of the hole portion 30*a*12, and the contact surface 30*a*6 as a second inclined surface (ramming surface) on the other side relative to the imaginary plane 1 and inclined with respect to the imaginary plane 1 so as to contact with the photosensitive drum 1 and provided on the inner surface of the hole portion 30*a*12. Also, the bearing portion 30*b* as a second supporting member has the hole portion 30*b*12 as a second hole portion for supporting the other lengthwise end of the photosensitive drum 1, the contact surface 30*a*6 as a third inclined surface (ramming surface) on one side relative to the imaginary plane 1 and inclined with respect to the imaginary plane 1 so as to contact with the photosensitive drum 1 and provided on the inner surface of the hole portion 30*b*12, and the contact surface 30*a*6 as a fourth inclined surface (ramming surface) on the other side relative to the imaginary plane 1 and inclined with respect to the imaginary plane 1 so as to contact with the photosensitive drum 1 and provided on the inner surface of the hole portion 30*b*12.

The direction of the resultant force of the forces acting on the photosensitive drum 1 by the plurality of process means is a direction in which the photosensitive drum 1 is urged against the contact surface 30*a*6 as the first inclined surface and the contact surface 30*a*6 as the second inclined surface, and against the contact surface 30*a*6 as the third inclined surface and the contact surface 30*a*6 as the fourth inclined surface. In other words, the contact surfaces 30*a*6 are disposed in the direction of the resultant force of the forces.

In the present embodiment, the resultant force of the forces is the resultant force of forces which are (i) a force with which the charging roller 2 is resiliently urged against the photosensitive drum 1 by the resilient forces of the springs 85, (ii) a force with which the developing roller 40 is resiliently urged against the photosensitive drum 1 by the resilient forces of the springs 54*a* and 54*b*, and the frictional force with the photosensitive drum 1 by the developing roller 40, (iii) a force with which the elastic cleaning blade 60 elastically urges the photosensitive drum 1, and the frictional force with the photosensitive drum 1 by the blade 60, (iv) a force with which the transfer roller is resiliently biased against the photosensitive drum 1 by the resilient forces of the springs 82, (v) the frictional force with the photosensitive drum 1 by the recording medium S produced when the recording medium S passes the transfer roller, and (vi) gravity acting on the photosensitive drum 1. The direction of the resultant force is a direction in which the photosensitive drum 1 is urged against the contact surface 30*a*6 as the first inclined surface and the contact surface 30*a*6 as the second inclined surface, and against the contact surface 30*a*6 as the third inclined surface and the contact surface 30*a*6 as the fourth inclined surface. That is, the contact surfaces 30*a*6 are disposed in the direction of the resultant force.

In the present embodiment, no consideration is given to the frictional forces of the transfer roller and the charging roller 2 with the photosensitive drum 1. This is because these rollers are driven to rotate by the photosensitive drum 1 and therefore, the frictional forces thereof are small as compared with the frictional forces with the developing roller 40 and the blade 60 and do not affect the resultant force. However, when they affect the resultant force, it is necessary to take it into account. Also, while in the present embodiment, the resultant force is taken into account about the items, this is not restrictive. If there is any other member urged against the photosensitive drum, it should be taken into account. Also, if even in the case of the items, the urging force thereof is small, it is considered that there is a case where it need not be taken into account.

Also, in the present embodiment, the contact surface 30*a*6 as the first inclined surface (ramming surface) and the contact surface 30*a*6 as the second inclined surface (ramming surface) are disposed symmetrically with respect to the imaginary plane 1. Also, the contact surface 30*a*6 as the third inclined surface (ramming surface) and the contact surface 30*a*6 as the fourth inclined surface (ramming surface) are disposed symmetrically with respect to the imaginary plane 1 (FIGS. 12A, 12B, 13A and 13B).

As shown in FIG. 12B, each contact surface 30*a*6 is disposed in a direction in which it receives the resultant force Vta of the forces urging the photosensitive drum 1. Two contact surfaces 30*a*6 have their mutual disposition angles set so that a component force Vta2 may always work toward the point of intersection between the two contact surfaces 30*a*6. That is, this relation holds true if the angle θ3 formed by the vector of the resultant force Vta with respect to the contact surface 30*a*6 (which is an angle formed between the contact surface 30*a*6 and the vector of the resultant force Vta urging the contact surface 30*a*6, and an angle on the rotation center side of the photosensitive drum 1 relative to the vector of the resultant force Vta) is always 90° or greater (an obtuse angle). By doing so, without adding urging means (biasing means) for urging the shaft portion 70 against the photosensitive drum 1, the position of the photosensitive drum 1 relative to the bearing member 30 is determined by only the force applied to the photosensitive drum 1 by the process means.

However, even if the angle θ3 is 90° or greater, when the contact surface angle θ2 shown in FIG. 12B (the angle formed between an imaginary plane 1 extended from the contact surface 30*a*6 and an imaginary plane 1 passing through the rotation center of the photosensitive drum 1, in the present embodiment, about 50) becomes small, the static position of the photosensitive drum 1 relative to the variation shaved amount may become great. If this variation is great, the distance fluctuation of the photosensitive drum 1 relative to the scanner unit may become great and affect color misregistration in a main scanning direction.

Figure 13A:
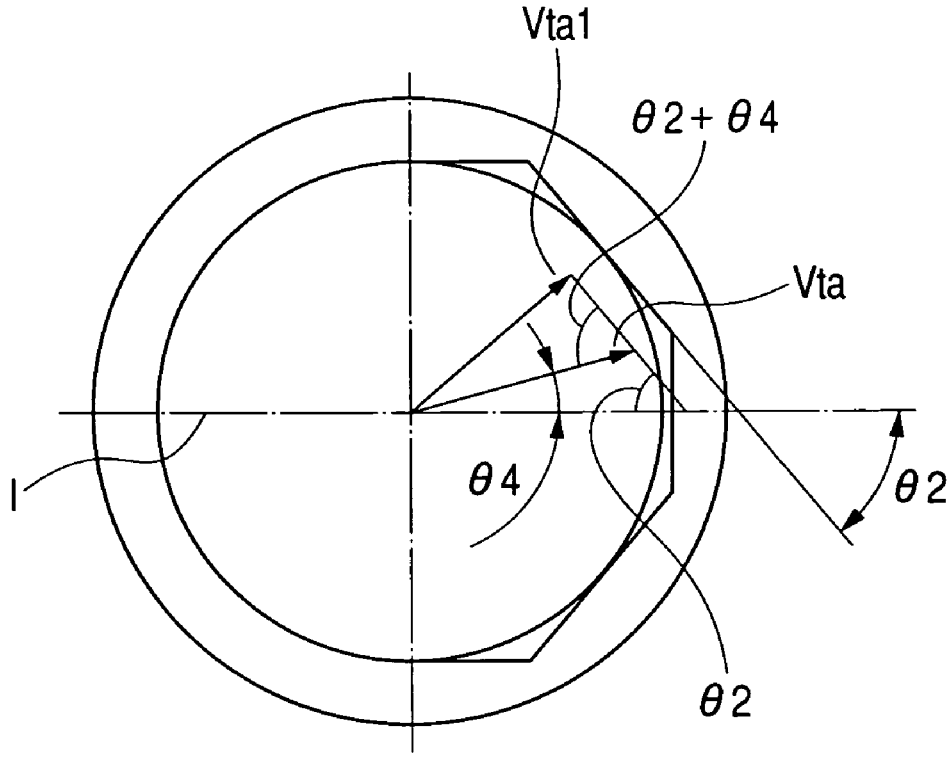
FIG. 13A is a schematic cross-sectional view showing the definition of the angle of the inclined surface of the bearing hole portion.
Figure 13B:
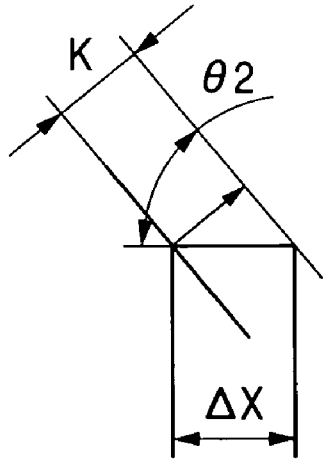
FIG. 13B shows the deviation amount Dx of an abutting point caused by a shaved amount K.

Describing this, as shown in FIG. 13B, the deviation amount DX of the abutting point caused by the shaved amount K can be represented by $\Delta X = K/\mathrm{Sin}\theta 2$.

Also, a component Vta1 perpendicular to the tangent 30*a*6 of the resultant force Vta acting on the tangent 30*a*6 can be represented by $\mathrm{Vta}1 = \mathrm{Vta} \times \mathrm{Sin}(\theta 2 + \theta 4)$. θ4 is a constant.

Assuming that the shaved amount K is proportional to the perpendicular component Vta1, $\Delta X = \mathrm{Vta}\ (\mathrm{Cos}\ \theta 4 + \mathrm{Sin}\ \theta 4 \times 1/\tan\ \theta 2)$.

Consequently, if the angle θ2 becomes great, the shaved amount ΔX becomes small. Accordingly, it is desired that the angle θ3 be in the vicinity of 90° as far as possible.

The angle θ3 is set so as to be $\theta 3 \geqq 90$ relative to the vector of the lower side in the resultant force vector range θ1. Along therewith, the tangent angle θ2 is set to the same angle (50°) with respect to the main body horizontal line, whereby the tangent angle θ3 with respect to the vector of the upper side is determined.

When as in the present embodiment, there is adopted a construction in which the flanges 70 and 71 of the photosensitive drum 1 are supported at two points on the two non-parallel contact surfaces formed on the hole portions 30*a*12 and 30*b*12 of the bearing member 30, the position variation of the photosensitive drum can be effectively suppressed as compared with the conventional bearing of which the sliding portion is of a round shape.

Figure 14A:
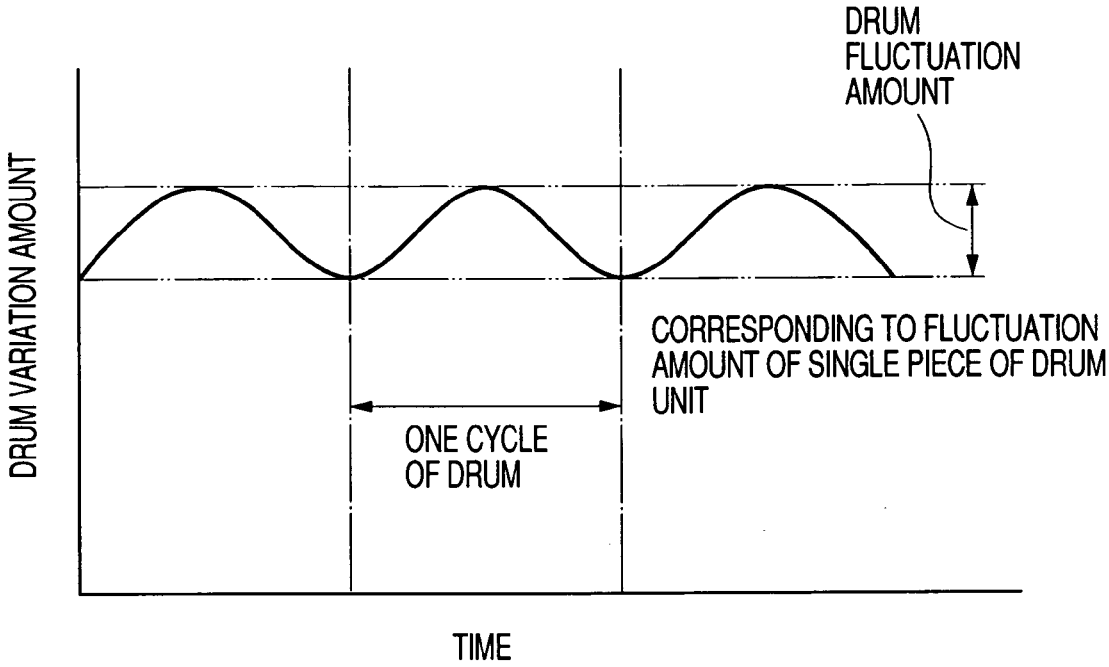
FIGS. 14A and 14B are graphs having measured the variation amount of a drum position showing an effect.
Figure 14B:
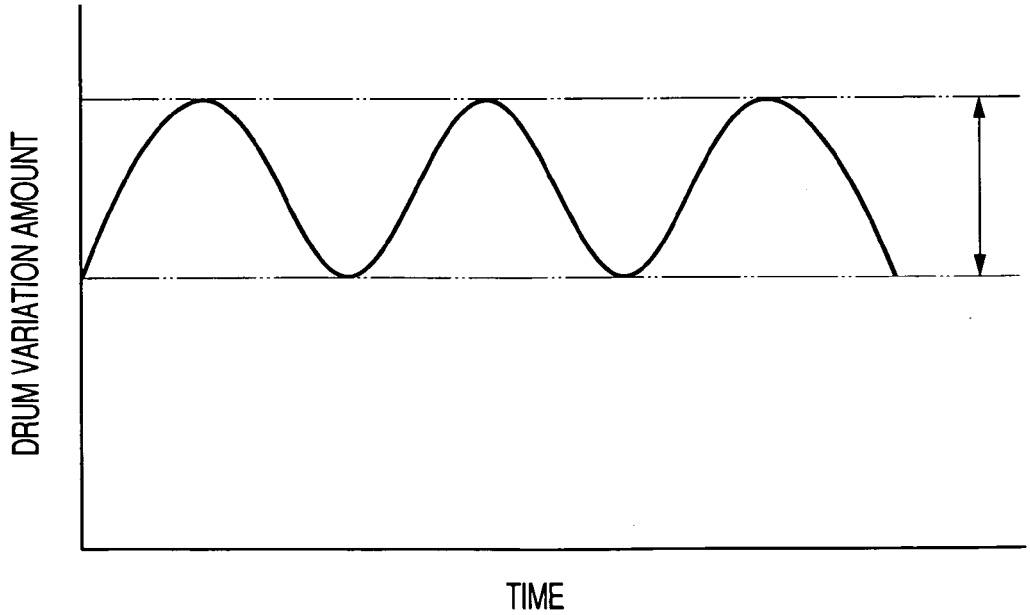

That is, as shown in FIG. 14A, when there is adopted the bearing construction as shown in the present embodiment, only the fluctuation amount of the photosensitive drum unit singly is measured. In contrast, as shown in FIG. 14B, in the conventional bearing hole portion shape (round shape), a fluctuation amount greater than the fluctuation amount of the photosensitive drum unit singly is measured. This represents that the position of the photosensitive drum is fluctuated within the sliding backlash with the bearing. Thus, the construction in which the photosensitive drum 1 is supported at two points is effective to suppress the position variation of the photosensitive drum. FIGS. 14A and 14B are graphs in which the drum variation amount is plotted on the ordinate axis and time is plotted on the abscissa axis. These graphs show the variation amount of the drum at one cycle of the drum.

As shown in FIG. 12A, the vector range θ1 of the resultant force Vta biasing the photosensitive drum 1 in the present embodiment varies upwardly within the range of 20° and downwardly within the range of 40°, with respect to the main body horizontal. In the present embodiment, as shown in FIG. 12B, the two tangent angles θ2 are the same angles, and a line linking the point of intersection between the two tangents and the rotation center of the photosensitive drum 1 together is parallel to the main body horizontal. The two tangent angles can be set to angles conforming to the resultant force vector range of an internal force, but in the present embodiment, as previously described, in order to make θ3 approximate to 90° as far as possible, the angle of the tangent 30*a*6 is set to θ2=about 50° with respect to the main body horizontal.

Figure 15A:
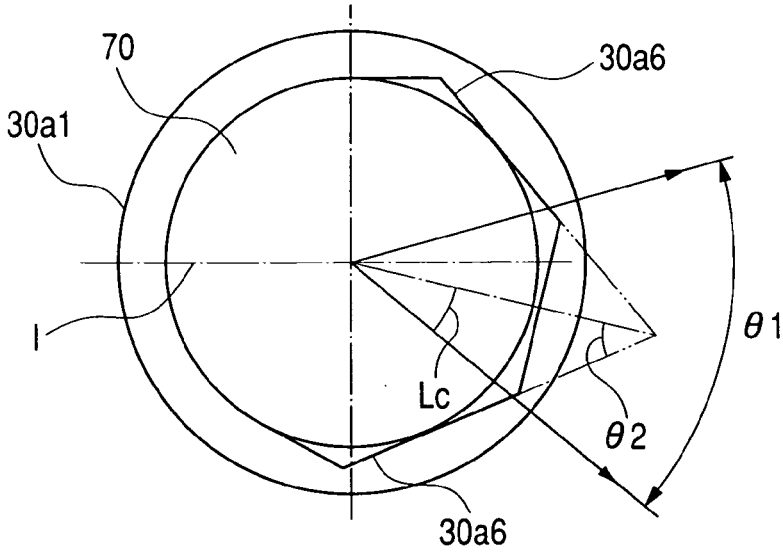
FIGS. 15A, 15B and 15C are cross-sectional views of other examples of the shape of the bearing hole portion of the photosensitive drum.

Regarding the angles θ2 of the tangents 30*a*6, as shown in FIG. 15A, angle setting may be done with respect to a center-parted line Lc within the vector range of the resultant force (the range of the angle θ1) applied to the photosensitive drum. The then angle θ2 can be set at the same angle.

Figure 15B:
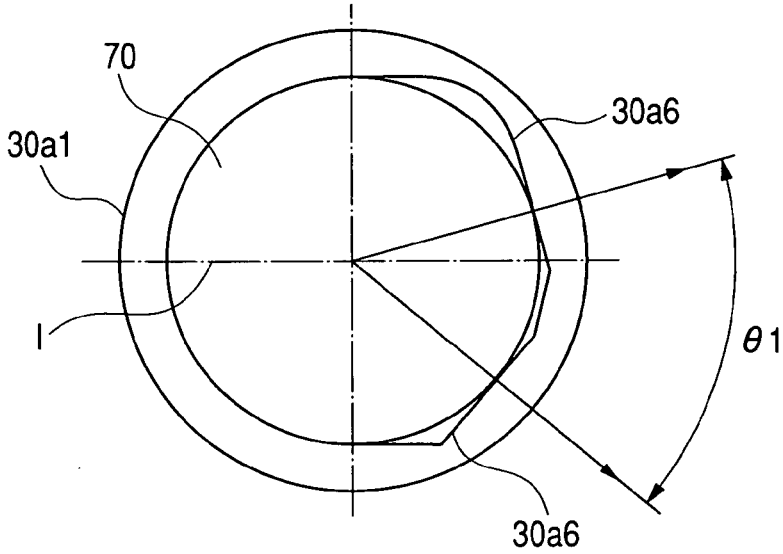
Figure 15C:
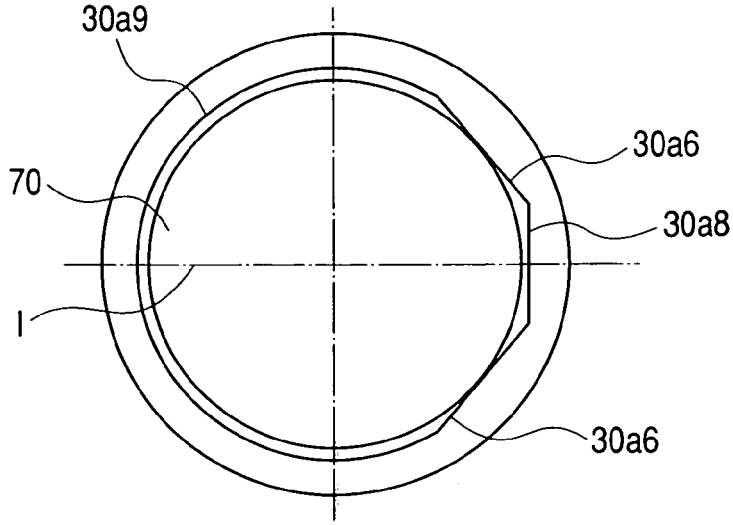

Further, when as in the present embodiment, the vector of the resultant force differs between the upper side and the lower side with respect to the main body horizontal, it is not necessary to set the angles of the tangents 30*a*6 to the same angles. For example, as shown in FIG. 15B, the angles of the tangents 30*a*6 can be in a relation of 90° or greater to each of the upper and lower vectors within the vector range θ1 of the resultant force.

Also, regarding the shape of the hole portions 30*a*12 and 30*b*12 of the bearing member 30, the other portion than the tangents 30*a*6 may be a certain degree of escape surface 30*a*9 relative to the supported shaft portions.

Also, the present embodiment is of a construction in which the shaft portion flanges at the opposite ends of the photosensitive drum 1 are supported, but a similar effect can be obtained even if the outer diameter of the cylinder 1*a* is directly supported by a resin bearing. According to the present embodiment, however, the outer diameter of the shaft portions 70 and 71 is smaller than the outer diameter of the cylinder 1*a*. Therefore, if as in the present embodiment, the shaft portions are supported, the photosensitive drum supporting apparatus can be more downsized.

Also, while in the present embodiment, design is made such that the plurality of process means such as the charging roller 2, the developing roller 40 and the cleaning blade 60 are biased against the photosensitive drum 1, it is not necessary for all of the process means to be biased against the photosensitive drum 1, but at least some of the plurality of process means can be designed to be biased against the photosensitive drum 1.

In the aforedescribed manner, the photosensitive drum 1 is brought into contact with the two non-parallel contact surfaces formed on the bearing member 30 to thereby position the photosensitive drum 1, whereby the position variation of the photosensitive drum 1 is suppressed. Thereby, it can be realized to improve the quality of image. The contact of the photosensitive drum 1 is effected by the urging (biasing) of the process means, whereby it is not necessary to discretely provide urging means (biasing means), and the number of parts can be decreased. Also, the cartridge, and further the image forming apparatus can be downsized. Also, a lower cost can be realized.

Also, the position variation of the photosensitive drum can be suppressed. This is particularly effective to prevent color misregistration in a multi-color image forming apparatus in which a plurality of cartridges 7 are mounted to thereby obtain a multi-color image.

[Bearing Member]

As previously described, the present embodiment is designed such that the photosensitive drum 1 is positioned on the bearing member 30. Further, in the present embodiment, the positioned members (positioned portions) which have heretofore been constructed as a discrete part are provided integrally with the bearing member 30 for positioning the photosensitive drum 1. Thereby, the positional accuracy with respective main units and parts when the photosensitive drum 1 is the center to the construction of the cartridge 7 is enhanced.

Specifically, in the present embodiment, the outer peripheries of the positioned portions 30*a*1 and 30*b*1 having the aforedescribed hole portions are rammed against the main body positioning portion 103, whereby the positioning of the cartridge 7 relative to the main body 100A of the apparatus is effected. Thereby, when the cartridge has been mounted on the main body 100A of the apparatus, the positioning of the photosensitive drum 1 relative to the main body 100A of the apparatus is accurately effected through the bearing members 30.

Also, the guides 30*a*10 and 30*b*10 which provide guides when the cartridge 7 is mounted on the main body 100A of the apparatus are provided integrally with the bearing members 30 (see FIGS. 4A and 4B). Thereby, when together with the positioned portions 30*a*1 and 30*b*1, the cartridge 7 is mounted on the main body 100A of the apparatus, the positioning of the photosensitive drum can be effected more accurately.

Also, the guides 30*a*10 and 30*b*10 function as guides for guiding the cartridge 7 in a predetermined direction (to a mounting position) when the cartridge 7 is mounted on the main body 100A of the apparatus. After the mounting, the guides 30*a*10 and 30*b*10 also function as rotation stoppers for restraining the cartridge 7 from rotating when the cartridge 7 has received a driving force. Therefore, if the guides 30*a*10 and 30*b*10 are provided near an exposure window into which the laser beam L from the scanner unit enters, it is readily possible to accurately set the positional relations of the photosensitive drum 1 and the exposure window to the main body 100A of the apparatus. Thereby, the accuracy of the application of the laser beam L to the photosensitive drum 1 can be enhanced.

Also, in the present embodiment, the grip portions 30*a*11 and 30*b*11 are provided integrally with the bearing member 30. Therefore (see FIG. 3), it is possible to decrease the number of parts when the cartridge 7 is mounted and dismounted with respect to the main body 100A of the apparatus.

Further, spring supporting portions 30*a*13 and 30*b*13 for restraining one end portion of the developing pressure springs 54*a* and 54*b* for biasing the developing roller 40 toward the photosensitive drum 1 are provided integrally with the bearing member 30 (see FIGS. 10A, 10B and 16). By the spring supporting portions 30*a*13 and 30*b*13 being thus provided integrally with the bearing members 30 for positioning the photosensitive drum 1, the urging direction (biasing direction) and the urging force (biasing force) when the developing roller 40 is urged (biased) against the photosensitive drum 1 can be set more accurately and easily.

In FIG. 16, the reference numeral 83 designates a transfer roller bearing, and the reference numeral 84 denotes a charging roller bearing.

Also, as shown in FIGS. 4A and 4B, the cartridge 7 of the present embodiment is such that a drum shutter 91, as a drum protecting member for protecting the photosensitive drum 1 when the cartridge 7 is detached from the main body 100A of the apparatus, is provided for pivotal movement about drum supporting members 90*a* and 90*b*. Thereby, the shutter 91 can be opened and closed. This shutter 91 is in its closed state when the cartridge 7 is not mounted on the main body 100A of the apparatus, and covers the photosensitive drum 1 to thereby protect the photosensitive drum 1. On the other hand, when the cartridge 7 is inserted into the main body 100A of the apparatus, the shutter 91 comes into engagement with a shutter opening and closing mechanism (not shown) provided in the main body of the apparatus 100 and is opened. It thus exposes the photosensitive drum 1 from the frame 51.

In the present embodiment, the drum supporting members 90*a* and 90*b* for supporting the drum shutter 91 are provided integrally with the bearing member 30. That is, the drum supporting members 90*a* and 90*b* are provided on the bearing members 30 which provides a positioning member when the cartridge 7 is mounted on the main body 100A of the apparatus. Thereby, the positional accuracy of the drum shutter 91 and the shutter opening and closing mechanism (not shown) provided in the main body 100A of the apparatus is stabilized. Accordingly, the opening and closing operation of the drum shutter 91 can be precisely performed while the photosensitive drum 1 is protected.

The members as previously described are provided integrally with the bearing member 30 for positioning the photosensitive drum 1 and the bearing member 30 is given a plurality of functions, whereby it is possible to enhance the positional accuracy of each member relative to the main body of the apparatus with the photosensitive drum 1 as the center. As compared with a case where the respective parts are constituted by discrete members, the number of parts can be curtailed to thereby realize a reduction in cost. Also, the downsizing of the photosensitive drum supporting apparatus and the cartridge can be promoted. Also, it becomes possible to achieve an improvement in the assembling work property for the photosensitive drum supporting apparatus and the cartridge.

An effect of the present invention is an improvement in the rotational accuracy of the electrophotographic photosensitive drum.

Also, an effect of the present invention is an improvement in the quality of image achieved by improving the rotational accuracy of the electrophotographic photosensitive drum.

Also, an effect of the present invention is an improvement in the rotational accuracy of the electrophotographic photosensitive drum achieved without the number of parts being increased.

Also, an effect of the present invention is an improvement in the rotational accuracy of the electrophotographic photosensitive drum achieved without the image forming apparatus being made bulky.

Also, an effect of the present invention is an improvement in the rotational accuracy of the electrophotographic photosensitive drum achieved with an increase in cost suppressed.

Also, an effect of the present invention is, in improving the rotational accuracy of the electrophotographic photosensitive drum, to make the direction of the resultant force of a force acting on the electrophotographic photosensitive drum by a plurality of process means into a direction in which the electrophotographic photosensitive drum is urged against a first inclined surface and a second inclined surface and against a third inclined surface and a fourth inclined surface, to thereby realize urging the electrophotographic photosensitive drum against each inclined surface, and thereby suppress an increase in the number of parts.

While the invention has been described with reference to the structure disclosed herein, it is not confined to the details set forth and this application is intended to cover such modifications or changes as may come within the purpose of the improvements or the scope of the following claims.

This application claims priority from Japanese Patent Application Nos. 2004-129672 filed Apr. 26, 2004 and 2004-273213 filed on Sep. 21, 2004, which is hereby incorporated by reference herein.

What is claimed is:

1. An electrophotographic photosensitive drum supporting apparatus for rotatably supporting an electrophotographic photosensitive drum used in an electrophotographic image forming apparatus, said electrophotographic photosensitive drum supporting apparatus comprising:

a first supporting member having a first hole portion for supporting one lengthwise end of the electrophotographic photosensitive drum, a first inclined surface on one side of said first supporting member relative to an imaginary plane passing through an axis of said electrophotographic photosensitive drum supported by said supporting apparatus and inclined with respect to said imaginary plane so as to contact the electrophotographic photosensitive drum and provided on an inner surface of said first hole portion, and a second inclined surface on the other side of said first supporting member relative to said imaginary plane and inclined with respect to said imaginary plane so as to contact the electrophotographic photosensitive drum and provided on the inner surface of said first hole portion;

a second supporting member having a second hole portion for supporting the other lengthwise end of said electrophotographic photosensitive drum, a third inclined surface on one side of said second supporting member relative to said imaginary plane and inclined with respect to said imaginary plane so as to contact the electrophotographic photosensitive drum and provided on an inner surface of said second hole portion, and a fourth inclined surface on the other side of said second supporting member relative to said imaginary plane and inclined with respect to said imaginary plane so as to contact the electrophotographic photosensitive drum and provided on the inner surface of said second hole portion; and a plurality of process means provided in contact with the electrophotographic photosensitive drum, wherein the direction of a resultant force of a force acting on the electrophotographic photosensitive drum by said plurality of process means is a direction in which the electrophotographic photosensitive drum is urged against said first inclined surface and said second inclined surface and against said third inclined surface and said fourth inclined surface, and wherein the electrophotographic photosensitive drum has a cylinder provided with a photosensitive layer, and shaft portions provided on one lengthwise end side and the other lengthwise end side of said cylinder configured and positioned to support said cylinder, said shaft portion provided on said one lengthwise end side being located in the interior of said first hole portion and urged against said first inclined surface and said second inclined surface provided on the inner surface of said first hole portion, and said shaft portion on said other lengthwise end side being located in the interior of said second hole portion and urged against said third inclined surface and said fourth inclined surface provided on the inner surface of said second hole portion.

2. An electrophotographic photosensitive drum supporting apparatus according to claim 1, wherein at least one of said process means includes a charging roller configured and positioned to charge the electrophotographic photosensitive drum, and said force acting on the electrophotographic photosensitive drum is a force resiliently urging said charging roller toward the electrophotographic photosensitive drum by a resilient force of a resilient member.

3. An electrophotographic photosensitive drum supporting apparatus according to claim 1 or 2, wherein at least one of said process means includes a developing roller configured and positioned to develop an electrostatic latent image formed on the electrophotographic photosensitive drum, and said force acting on the electrophotographic photosensitive drum is a force resiliently urging said developing roller toward the electrophotographic photosensitive drum by a resilient force of a resilient member.

4. An electrophotographic photosensitive drum supporting apparatus according to claim 1 or 2, wherein at least one of said process means includes an elastic cleaning blade configured and positioned to remove residual developer on the electrophotographic photosensitive drum from the electrophotographic photosensitive drum, and said force acting on the electrophotographic photosensitive drum is a force with which said elastic cleaning blade elastically urges the electrophotographic photosensitive drum.

5. An electrophotographic photosensitive drum supporting apparatus according to claim 1 or 2, wherein at least one of said process means includes a transfer roller configured and positioned to transfer a developer image formed on the electrophotographic photosensitive drum to a recording medium, and said force acting on the electrophotographic photosensitive drum is a force resiliently urging said transfer roller toward the electrophotographic photosensitive drum by a resilient force of a resilient member.

6. An electrophotographic photosensitive drum supporting apparatus according to claim 1, wherein at least one of said process means includes a charging roller configured and positioned to charge the electrophotographic photosensitive drum, a developing roller configured and positioned to develop an electrostatic latent image formed on the electrophotographic photosensitive drum, an elastic cleaning blade configured and positioned to remove residual developer on the electrophotographic photosensitive drum from the electrophotographic photosensitive drum, and a transfer roller configured and positioned to transfer a developer image formed on the electrophotographic photosensitive drum to a recording medium, and the direction of the resultant force of (i) a force resiliently urging said charging roller against the electrophotographic photosensitive drum by a resilient force of a resilient member, (ii) a force resiliently urging said developing roller against the electrophotographic photosensitive drum by the resilient force of the resilient member, and a frictional force with the electrophotographic photosensitive drum by said developing roller, (iii) a force with which said elastic cleaning blade elastically urges the electrophotographic photosensitive drum, and a frictional force with the electrophotographic photosensitive drum by said elastic cleaning blade, (iv) a force resiliently urging said transfer roller against the electrophotographic photosensitive drum by the resilient force of the resilient member, (v) a frictional force with the electrophotographic photosensitive drum produced when the recording medium passes said transfer roller and (vi) gravity acting on the electrophotographic photosensitive drum is a direction in which the electrophotographic photosensitive drum is urged against said first inclined surface and said second inclined surface and against said third inclined surface and said fourth inclined surface.

7. An electrophotographic photosensitive drum supporting apparatus according to claim 1, wherein said first inclined surface and said second inclined surface are disposed symmetrically with respect to said imaginary plane, and said third inclined surface and said fourth inclined surface are disposed symmetrically with respect to said imaginary plane.

8. A process cartridge detachably mountable on a main body of an electrophotographic image forming apparatus, said process cartridge comprising:

an electrophotographic photosensitive drum;

a plurality of process means provided in contact with said electrophotographic photosensitive drum;

a first supporting member having a first hole portion for supporting one lengthwise end of said electrophotographic photosensitive drum, a first inclined surface on one side of said first supporting member relative to an imaginary plane passing through an axis of said electrophotographic photosensitive drum and inclined with respect to said imaginary plane so as to contact said electrophotographic photosensitive drum and provided on an inner surface of said first hole portion, and a second inclined surface on the other side of said first supporting member relative to said imaginary plane and inclined with respect to said imaginary plane so as to contact said electrophotographic photosensitive drum and provided on the inner surface of said first hole portion;

a second supporting member having a second hole portion for supporting the other lengthwise end of said electrophotographic photosensitive drum, a third inclined surface on one side of said second supporting member relative to said imaginary plane and inclined with respect to said imaginary plane so as to contact said electrophotographic photosensitive drum and provided on an inner surface of said second hole portion, and a fourth inclined surface on the other side of said second supporting member relative to said imaginary plane and inclined with respect to said imaginary plane so as to contact said electrophotographic photosensitive drum and provided on the inner surface of said second hole portion, wherein the direction of a resultant force of a force acting on said electrophotographic photosensitive drum by said plurality of process means is a direction in which said electrophotographic photosensitive drum is urged against said first inclined surface and said second inclined surface and against said third inclined surface and said fourth inclined surface, and wherein said electrophotographic photosensitive drum has a cylinder provided with a photosensitive layer, and shaft portions provided on one lengthwise end side and the other lengthwise end side of said cylinder configured and positioned to support said cylinder, said shaft portion provided on said one lengthwise end side being located in the interior of said first hole portion and urged against said first inclined surface and said second inclined surface provided on the inner surface of said first hole portion, and said shaft portion on said other lengthwise end side being located in the interior of said second hole portion and urged against said third inclined surface and said fourth inclined surface provided on the inner surface of said second hole portion.

9. A process cartridge according to claim 8, wherein at least one of said process means includes a charging roller configured and positioned to charge said electrophotographic photosensitive drum, and said force acting on said electrophotographic photosensitive drum is a force resiliently urging said charging roller against said electrophotographic photosensitive drum by a resilient force of a resilient member.

10. A process cartridge according to claim 8 or 9, wherein at least one of said process means includes a developing roller configured and positioned to develop an electrostatic latent image formed on said electrophotographic photosensitive drum, and said force acting on said photosensitive drum is a force resiliently urging said developing roller against said electrophotographic photosensitive drum by a resilient force of a resilient member.

11. A process cartridge according to claim 8 or 9, wherein at least one of said process means includes an elastic cleaning blade configured and positioned to remove residual developer on said electrophotographic photosensitive drum from said electrophotographic photosensitive drum, and said force acting on said electrophotographic photosensitive drum is a force with which said elastic cleaning blade elastically urges said electrophotographic photosensitive drum.

12. A process cartridge according to claim 8 or 9, wherein at least one of said process means includes a transfer roller configured and positioned to transfer a developer image formed on said electrophotographic photosensitive drum to a recording medium, and said force acting on said electrophotographic photosensitive drum is a force resiliently urging said transfer roller against said electrophotographic photosensitive drum by a resilient force of a resilient member.

13. A process cartridge according to claim 8, wherein at least one of said process means includes a charging roller configured and positioned to charge said electrophotographic photosensitive drum, a developing roller configured and positioned to develop an electrostatic latent image formed on said electrophotographic photosensitive drum, an elastic cleaning blade configured and positioned to remove residual developer on said electrophotographic photosensitive drum from said electrophotographic photosensitive drum, and a transfer roller configured and positioned to transfer a developer image formed on said electrophotographic photosensitive drum to a recording medium, and the direction of the resultant force of (i) a force resiliently urging said charging roller against said electrophotographic photosensitive drum by a resilient force of a resilient member, (ii) a force resiliently urging said developing roller against said electrophotographic photosensitive drum by the resilient force of the resilient member, and a frictional force with said electrophotographic photosensitive drum by said developing roller, (iii) a force with which said elastic cleaning blade elastically urges said electrophotographic photosensitive drum, and a frictional force with said electrophotographic photosensitive drum by said elastic cleaning blade, (iv) a force resiliently urging said transfer roller by the resilient force of the resilient member and (v) gravity acting on said electrophotographic photosensitive drum is the direction in which said electrophotographic photosensitive drum is urged against said first inclined surface and said second inclined surface and against said third inclined surface and said fourth inclined surface.

14. A process cartridge according to claim 8, wherein said first inclined surface and said second inclined surface are disposed symmetrically with respect to said imaginary plane, and said third inclined surface and said fourth inclined surface are disposed symmetrically with respect to said imaginary plane.

15. An electrophotographic image forming apparatus on which a process cartridge is detachably mountable for forming an image on a recording medium, said electrophotographic image forming apparatus comprising:

(i) a process cartridge including:

an electrophotographic photosensitive drum;

a plurality of process means provided in contact with said electrophotographic photosensitive drum;

a first supporting member having a first hole portion for supporting one lengthwise end of said electrophotographic photosensitive drum, a first inclined surface on one side of said first supporting member relative to an imaginary plane passing through an axis of said electrophotographic photosensitive drum and inclined with respect to said imaginary plane so as to contact said electrophotographic photosensitive drum and provided on an inner surface of said first hole portion, and a second inclined surface on the other side of said first supporting member relative to said imaginary plane and inclined with respect to said imaginary plane so as to contact said electrophotographic photosensitive drum and provided on the inner surface of said first hole portion; and a second supporting member having a second hole portion for supporting the other lengthwise end of said electrophotographic photosensitive drum, a third inclined surface on one side of said second supporting member relative to said imaginary plane and inclined with respect to said imaginary plane so as to contact said electrophotographic photosensitive drum and provided on an inner surface of said second hole portion, and a fourth inclined surface on the other side of said second supporting member relative to said imaginary plane and inclined with respect to said imaginary plane so as to contact with said electrophotographic photosensitive drum and provided on the inner surface of said second hole portion, wherein the direction of a resultant force of a force acting on said electrophotographic photosensitive drum by said plurality of process means is a direction in which said electrophotographic photosensitive drum is urged against said first inclined surface and said second inclined surface and against said third inclined surface and said fourth inclined surface, said process cartridge being detachably mounted on a mounting portion, wherein said electrophotographic photosensitive drum has a cylinder provided with a photosensitive layer, and shaft portions provided on one lengthwise end side and the other lengthwise end side of said cylinder configured and positioned to support said cylinder, said shaft portion provided on said one lengthwise end side being located in the interior of said first hole portion and urged against said first inclined surface and said second inclined surface provided on the inner surface of said first hole portion, and said shaft portion on said other lengthwise end side being located in the interior of said second hole portion and urged against said third inclined surface and said fourth inclined surface provided on the inner surface of said second hole portion, and (ii) conveying means for conveying the recording medium.

* * * * *